US009366088B2

(12) United States Patent
Cox

(10) Patent No.: US 9,366,088 B2
(45) Date of Patent: Jun. 14, 2016

(54) CUTTER ASSEMBLIES, DISC CUTTERS, AND RELATED METHODS OF MANUFACTURE

(71) Applicant: US Synthetic Corporation, Orem, UT (US)

(72) Inventor: Edwin Sean Cox, Spanish Fork, UT (US)

(73) Assignee: US SYNTHETIC CORPORATION, Orem, UT (US)

( * ) Notice: Subject to any disclaimer, the term of this patent is extended or adjusted under 35 U.S.C. 154(b) by 464 days.

(21) Appl. No.: 13/790,019

(22) Filed: Mar. 8, 2013

(65) Prior Publication Data

US 2014/0251696 A1 Sep. 11, 2014

(51) Int. Cl.

| | |
|---|---|
| ***E21B 10/52*** | (2006.01) |
| ***E21B 10/12*** | (2006.01) |
| ***B24D 18/00*** | (2006.01) |
| ***E21D 9/10*** | (2006.01) |

(52) U.S. Cl.

CPC ..... *E21B 10/52* (2013.01); *E21B 10/12* (2013.01); *E21D 9/1006* (2013.01)

(58) Field of Classification Search

CPC ..... E21B 10/12; E21B 10/52; E21D 9/104; E21D 9/1006; B24D 18/00; B24D 18/0072; E02F 3/142

See application file for complete search history.

(56) References Cited

U.S. PATENT DOCUMENTS

| | | | | | |
|---|---|---|---|---|---|
| 3,791,465 | A | * | 2/1974 | Metge | 175/373 |
| 3,981,370 | A | * | 9/1976 | Bingham et al. | 175/373 |
| 4,298,080 | A | | 11/1981 | Hignett | |
| 4,339,009 | A | * | 7/1982 | Busby | 175/374 |
| 4,756,631 | A | | 7/1988 | Jones | |
| 4,793,427 | A | * | 12/1988 | Lambson et al. | 175/373 |
| 4,802,539 | A | | 2/1989 | Hall et al. | |
| 5,234,064 | A | * | 8/1993 | Lenaburg | 175/373 |
| 5,273,125 | A | | 12/1993 | Jurewicz | |
| 5,351,770 | A | | 10/1994 | Cawthorne et al. | |
| 5,598,895 | A | | 2/1997 | Anderson et al. | |
| 5,626,201 | A | | 5/1997 | Friant et al. | |

(Continued)

FOREIGN PATENT DOCUMENTS

| | | |
|---|---|---|
| CN | 201763353 | 3/2011 |
| DE | 19821390 | 11/1999 |

(Continued)

OTHER PUBLICATIONS

International Search Report and Written Opinion from International Application No. PCT/US2014/022049 mailed Mar. 6, 2015.

(Continued)

*Primary Examiner* — Daniel P Stephenson

(74) *Attorney, Agent, or Firm* — Dorsey & Whitney LLP

(57) ABSTRACT

In an embodiment, a cutter assembly for use on a tunnel boring machine may include a cutter ring extending circumferentially about a central axis. The cutter ring may include a radially inner surface and a radially outer surface. The cutter assembly may also include superabrasive cutting elements distributed circumferentially about the axis. Each of the superabrasive cutting elements may be attached to the cutter ring and may include a polycrystalline diamond ("PCD") body having a working surface. At least a number of the cutting elements may extend beyond the outer surface of the cutter ring.

18 Claims, 21 Drawing Sheets

(56) References Cited

U.S. PATENT DOCUMENTS

| | | | | |
|---|---|---|---|---|
| 5,628,549 | A | 5/1997 | Ritchey et al. | |
| 5,904,211 | A | 5/1999 | Friant et al. | |
| 5,906,245 | A | 5/1999 | Tibbitts et al. | |
| 5,961,185 | A | 10/1999 | Friant et al. | |
| 6,340,245 | B1 | 1/2002 | Horton et al. | |
| 6,367,569 | B1 | 4/2002 | Walk | |
| 7,017,683 | B2 * | 3/2006 | Narvestad | 175/373 |
| 7,842,111 | B1 | 11/2010 | Sani | |
| 7,866,418 | B2 | 1/2011 | Bertagnolli et al. | |
| 7,896,551 | B2 | 3/2011 | Cooley et al. | |
| 8,079,431 | B1 * | 12/2011 | Cooley et al. | 175/432 |
| 8,236,074 | B1 | 8/2012 | Bertagnolli et al. | |
| 8,277,124 | B2 | 10/2012 | Sexton et al. | |
| 2001/0042644 | A1 | 11/2001 | Nishiyama et al. | |
| 2006/0144200 | A1 | 7/2006 | Duden | |
| 2008/0284236 | A1 | 11/2008 | Hall et al. | |
| 2009/0058172 | A1 | 3/2009 | de Andrade et al. | |
| 2009/0283332 | A1 | 11/2009 | Dick et al. | |
| 2009/0322143 | A1 | 12/2009 | Krauter | |
| 2011/0259150 | A1 | 10/2011 | Hall et al. | |
| 2011/0259646 | A1 | 10/2011 | Hall et al. | |
| 2012/0212034 | A1 * | 8/2012 | Shanahan et al. | 299/106 |
| 2013/0044971 | A1 | 2/2013 | Cooley et al. | |
| 2014/0251696 | A1 * | 9/2014 | Cox | 175/373 |

FOREIGN PATENT DOCUMENTS

| | | | | |
|---|---|---|---|---|
| WO | WO 9958808 | A1 * | 11/1999 | E21B 10/12 |
| WO | WO 2014/093662 | | 6/2014 | |

OTHER PUBLICATIONS

U.S. Appl. No. 13/790,046, filed Mar. 8, 2013, Cox.
U.S. Appl. No. 13/480,932, filed May 25, 2012, Tulet, et al.
U.S. Appl. No. 13/713,096, filed Dec. 13, 2012, Peterson, et al.
"Wear Patterns and Prediction of Disc Cutter Consumption for Tunnel Boring Machines" C. Frenzel, Colorado School of Mines, SME Annual Meeting, Feb. 27, 2011-Mar. 2, 2011, pp. 1-6.
International Search Report and Written Opinion from International Application No. PCT/US2014/022071 mailed Mar. 6, 2015.
U.S. Appl. No. 13/790,046, Jan. 30, 2015, Office Action.
U.S. Appl. No. 13/790,046, Oct. 5, 2015, Office Action.
U.S. Appl. No. 13/790,046, Feb. 25, 2016, Office Action.

* cited by examiner

CUTTER ASSEMBLIES, DISC CUTTERS, AND RELATED METHODS OF MANUFACTURE

BACKGROUND

A variety of cutters or bits are presently used in mechanical excavation systems. One type of cutter commonly used on cutterheads in rock excavation is a disc-type rolling cutter. For example, hardened steel disc cutters are frequently used on cutterheads employed in tunnel boring, raise drilling, large diameter blind drilling, and/or small diameter drilling systems.

In hard rock, the disc cutter may be used to apply great thrust on the cutter, and consequently pressure on the rock to be cut, a zone of rock directly beneath (i.e., in the cutting direction) and adjacent to the disc cutter is crushed, normally forming very fine particles. The crushed zone may form a hydraulic-like pressure downward (again, in the cutting direction) and outward against adjacent rock. The adjacent rock then cracks, and chips spall from the rock face being excavated. The crushed rock is then collected and removed as debris.

The service life of disc cutters can be a significant limitation in the operating efficiency of mechanical excavation systems using such cutters. For example, because the disc cutters are typically pushed against hard rock surfaces (i.e., tunnel faces) with very significant forces including high shock loads and work in an abrasive, high wear environment, the disc cutters can wear at a rapid rate. These disc cutters may be replaced. However, to change disc cutters, mechanical excavation systems can be stopped for several hours while the disc cutters are removed, replaced, and/or repaired. This time and effort intensive repair activity reduces the overall efficiency or rate of mechanical excavation systems using the disc cutters.

In addition, disc cutters typically include bearing systems that allow the disc cutters to rotate on the target surface as the cutterhead rotates. If this bearing system fails, the disc cutter can stop turning. When the disc cutter stops turning, the portion of the disc cutter in contact with the target surface slides. This sliding contact can wear the disc cutter rapidly into a flat, wide spot that no longer is able to apply adequate compressive force against the target surface to crush hard rock or other hardened material.

Therefore, manufacturers and users of disc cutters continue to seek improved disc cutter designs and manufacturing techniques.

SUMMARY

Various embodiments of the invention relate to cutter assemblies, disc cutters, and related methods of manufacture. The various embodiments of the cutter assemblies and the disc cutters may be used in tunnel boring machines, raise drilling systems, large diameter blind drilling systems, and other types of mechanical systems.

In an embodiment, a cutter assembly for use on a tunnel boring machine may include a cutter ring extending circumferentially about a central axis. The cuter ring may include a radially inner surface and a radially outer surface. The cutter assembly may also include superabrasive cutting elements distributed circumferentially about the axis. Each of the superabrasive cutting elements may be attached to the cutter ring and may include a polycrystalline diamond ("PCD") body having a working surface. At least a number of the cutting elements may extend beyond the outer surface of the cutter ring.

In an embodiment, a disc cutter may include a shaft and a cutter assembly rotatably mounted on the shaft. The cutter assembly may include a cutter ring extending circumferentially about a central axis. The cutter ring may include a radially inner surface and a radially outer surface. The cutter assembly may further include superabrasive cutting elements distributed circumferentially about the axis. Each of the superabrasive cutting elements may be attached to the cutter ring and may include a PCD body having a working surface. At least a portion of one or more of the cutting elements may extend beyond the outer surface of the cutter ring. The disc cutter may further include one or more bearing apparatuses rotatably mounting the cutter assembly to the shaft.

In an embodiment, a method of manufacturing a cutter assembly for use on a tunnel boring machine may include coupling a plurality of superabrasive elements to a cutter ring. The cutter ring may include an inner surface and an outer surface having a plurality of pockets formed therein that carry the plurality of superabrasive cutting elements. At least a portion of one or more of the superabrasive cutting elements may extend beyond the outer surface of the cutter ring.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the invention, wherein identical reference numerals refer to identical or similar elements or features in different views or embodiments shown in the drawings.

DETAILED DESCRIPTION

Embodiments of the invention generally relate to tunnel boring machine cutter assemblies, disc cutters, and related methods of manufacture. The various embodiments of the cutter assemblies and the disc cutters may be used in tunnel boring machines ("TBMs"), raise drilling systems, large diameter blind drilling systems, and other types of systems.

Figure 1:
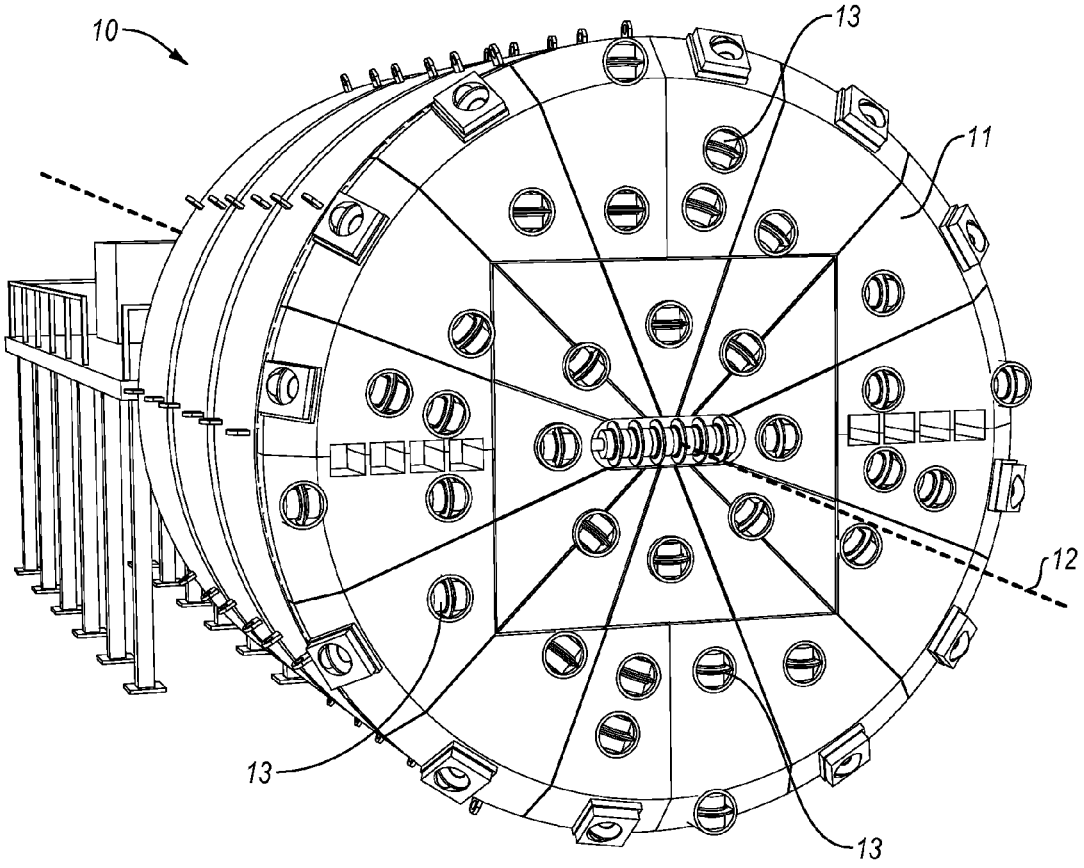
FIG. 1 is a schematic perspective view of a tunnel boring machine that may utilize any of the disclosed disc cutters according to various embodiments.
Figure 2A:
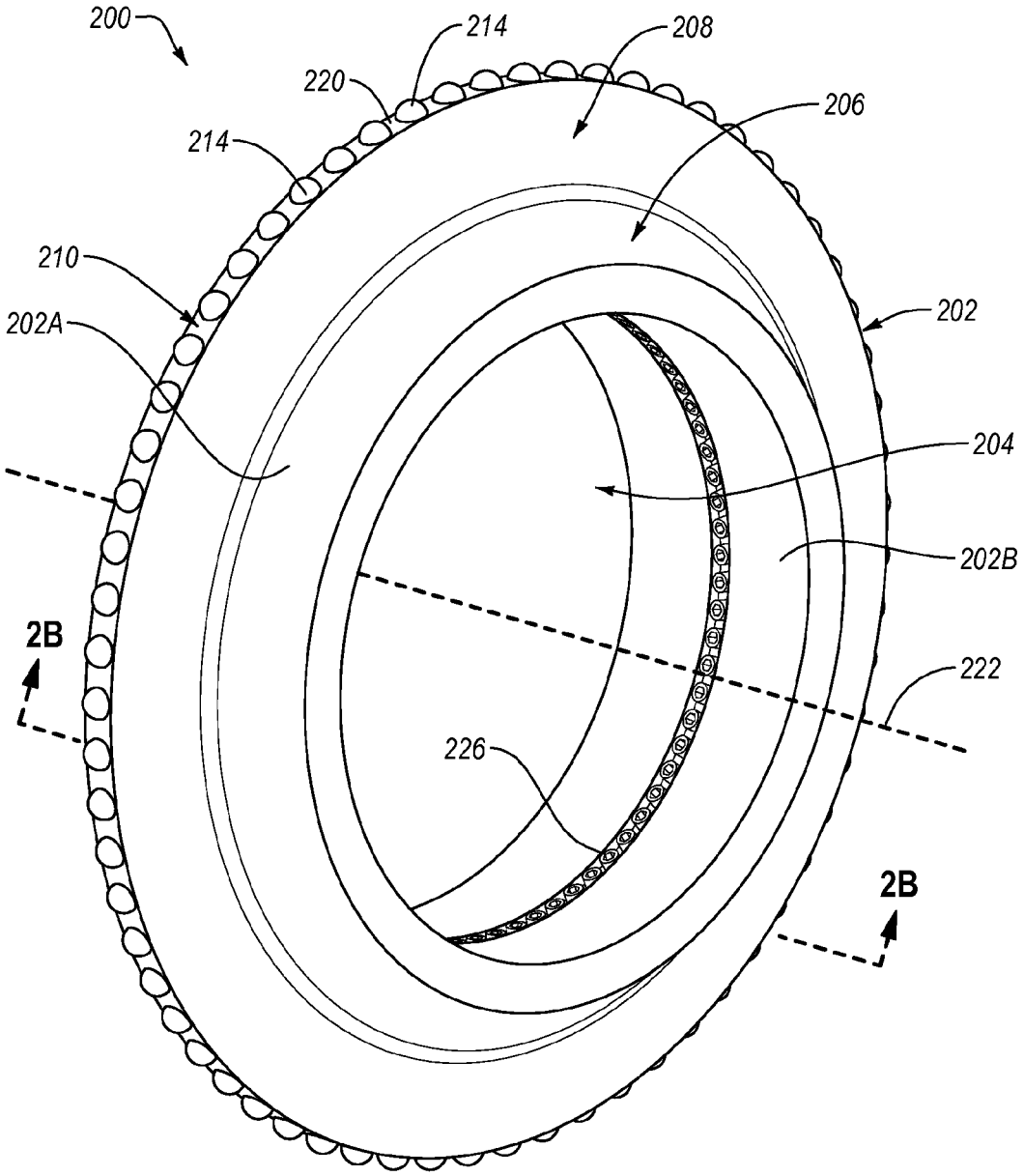
FIG. 2A is an isometric view of a cutter assembly according to an embodiment.

FIG. 1 is a schematic perspective view of a TBM 10 according to an embodiment. The TBM 10 may include a large rotating cutterhead or head 11 positioned at a front end of the TBM 10. The head 11 may be configured to rotate around a rotation axis 12 that is generally coaxial with the geometry of the tunnel. In an embodiment, one or more disc cutters 13 may be mounted to the rotating head 11. The disc cutters 13 may be mounted onto the head 11 in one or more patterns so that as the head 11 rotates about the rotation axis 12, the disc cutters 13 are able to contact selected portions of a target surface or tunnel face. The disc cutters 13 may comprise one or more cutter assemblies (e.g., shown in FIG. 2A) rotatably mounted via bearings onto a shaft (e.g., shown in FIG. 4B). The shaft, in turn, is secured to the head 11 and defines another rotation axis for the disc cutter 13 that is generally orthogonal to the rotation axis 12 of head 11. As the head 11 rotates about the rotation axis 12, the cutter assembly of the disc cutter 13 rotates on the shaft.

The disc cutters 13 may be configured to perform the task of excavating material (e.g., rock) from the target surface or tunnel face. For example, as the head 11 advances and rotates, the disc cutters 13 rotate and are pushed against the tunnel face typically under power from a system of hydraulic cylinders (not shown). The disc cutters 13 fractionate, crush, loosen materials, or combinations thereof, on the tunnel face, which may be transported away by the TBM 10. As described in more detailed below, in an embodiment, the disc cutters 13 may include one or more superabrasive cutting elements configured and positioned to contact and cut the target surface or tunnel face. As the loosened material is removed, the tunnel length increases as the TBM 10 advances to maintain engagement of the head with the tunnel face. Hydraulic cylinders may also be deployed along with means which push against the sides of the tunnel in order to react the force of the disc cutters 13 against the tunnel face.

FIG. 2A through 2E are isometric and cross-sectional views of a cutter assembly 200 according to an embodiment. The cutter assembly 200 may form a portion of a disc cutter used in a TBM. The cutter assembly 200 may include a cutter ring 202 having an outer surface 202A and an inner surface 202B defining an opening 204 through which a shaft (not shown) may extend. The cutter ring 202 may be made from a variety of different materials. For example, the cutter ring 202 may comprise a metal, alloy steel, a metal alloy, carbon steel, stainless steel, tungsten carbide, or any other suitable metal or conductive or non-conductive material. In an embodiment, the cutter ring 202 may comprise an annular ring exhibiting a wedge-like cross-sectional geometric shape. For example, the cutter ring 202 may include a base portion 206 from which a pair of side portions 208 extend and converge to define a crest 210. While the cutter ring 202 is illustrated exhibiting a generally wedge-like cross-sectional shape, the cutter ring 202 may exhibit any suitable cross-sectional geometric shape. For example, the cutter ring 202 may exhibit a constant cross-sectional shape, a generally conical cross-sectional shape, a generally rectangular cross-sectional shape, a bell-like cross-sectional shape, an asymmetric cross-sectional shape, a generally triangular cross-sectional shape, a generally trapezoidal cross-sectional shape, combinations thereof, or any other suitable cross-sectional geometric shape.

The cutter ring 202 may include a plurality of pockets 212 (shown in FIG. 2C) formed in the crest 210. The pockets 212 may be arranged in a signal row about a rotation axis 222. In other embodiments, the pockets 212 may be arranged in two rows, three rows, four rows, or any other suitable number of rows about a rotation axis 222. In the illustrated embodiment, the cutter ring 202 may also include a recessed channel 226 formed in the inner surface 202B that extends circumferentially about the rotation axis 222 and a plurality of through holes 228 extending between the pockets 212 and the recessed channel 226.

The cutter assembly 200 may further include a plurality of cutting elements 214. In an embodiment, one or more of the cutting elements 214 may have a generally domed hemispherical-like shape. In other embodiments, one or more of the cutting elements 214 may exhibit a generally rounded rectangular shape, a hemispherical shape, a pointed shape, a generally oval shape, a generally angular shape, combinations thereof, or any other suitable shape. Each of the cutting elements 214 may be partially disposed in a corresponding one of the pockets 212 (shown in FIG. 2B) of the cutter ring 202. As shown, the cutting elements 214 may be distributed circumferentially about the rotation axis 222. In an embodiment, gaps 220 may be located between adjacent cutting elements 214. In an embodiment, at least one of, some of, or all of the gaps 220 may exhibit a width of about 0.00020 inches to about 0.5 inches, such as about 0.00040 inches to 0.0010 inches, about 0.00040 inches to 0.080 inches, or about 0.1 inches to about 0.2 inches, about 0.2 inches to about 0.3 inches, about 0.3 inches to about 0.4 inches, or about 0.4 inches to about 0.5 inches. In other embodiments, the gaps 220 may have widths that are relatively larger or smaller. In other embodiments, the gaps 220 may substantially be zero.

Each cutting element 214 may include a superabrasive body 216 having a working upper surface 216A and an opposing back surface 216B. The term "superabrasive," as used herein, means a material having a hardness at least equal to a hardness of tungsten carbide. Each cutting element 214 optionally includes multiple layers or other components. For instance, the back surface 216B of one or more of the cutting elements 214 may be bonded or otherwise attached to a backing portion 218.

In any of the embodiments disclosed herein, the superabrasive bodies (e.g., superabrasive body 216) may at least partially comprise one or more superabrasive materials, such as natural diamond, sintered PCD, polycrystalline cubic boron nitride, diamond grains bonded together with silicon carbide, or combinations of the foregoing. For example, cutting elements having a PCD body may be formed and bonded to a backing portion using an ultra-high pressure, ultra-high temperature ("HPHT") sintering process. Such cutting elements having a PCD body may be fabricated by placing a cemented carbide backing portion, such as a cobalt-cemented tungsten carbide substrate, into a container or cartridge with a volume of diamond particles positioned on a surface of the cemented carbide substrate. A number of such cartridges may be loaded into an HPHT press. The backing portions and diamond particles may then be processed under HPHT conditions in the presence of a catalyst material that causes the diamond particles to bond to one another to form a diamond table having a matrix of bonded diamond crystals. The catalyst material is often a metal-solvent catalyst, such as cobalt, nickel, or iron, which facilitates intergrowth and bonding of the diamond particles. In an embodiment, a constituent of the cemented carbide backing portion, such as cobalt from a cobalt-cemented tungsten carbide substrate, liquefies and sweeps from a region adjacent to the volume of diamond particles into interstitial regions between the diamond particles during the HPHT process. The cobalt may act as a catalyst to facilitate the formation of bonded diamond gains.

In any of the embodiments disclosed herein, the polycrystalline diamond body may be leached to at least partially or substantially completely remove the metal-solvent catalyst (e.g., cobalt, iron, nickel, or alloys thereof) that was used to initially sinter precursor diamond particles that form the polycrystalline diamond. In another embodiment, an infiltrant used to re-infiltrate a preformed leached polycrystalline diamond table may be leached or otherwise removed to a selected depth from the upper working surface. Moreover, in any of the embodiments disclosed herein, the polycrystalline diamond may be unleached and include a metal-solvent catalyst (e.g., cobalt, iron, nickel, or alloys thereof) that was used to initially sinter the precursor diamond particles that form the polycrystalline diamond or an infiltrant used to re-infiltrate a preformed leached polycrystalline diamond body. Other examples of methods for fabricating the cutting elements are disclosed in U.S. Pat. Nos. 7,866,418; 7,842,111; and 8,236,074, the disclosure of each of which is incorporated herein, in its entirety, by this reference.

The diamond particles that may form the polycrystalline diamond in the superabrasive body may also exhibit a larger size and at least one relatively smaller size. As used herein, the phrases "relatively larger" and "relatively smaller" refer to particle sizes (by any suitable method) that differ by at least a factor of two (e.g., 30 μm and 15 μm). According to various embodiments, the diamond particles may include a portion exhibiting a relatively larger size (e.g., 40 μm, 30 μm, 20 μm, 15 μm, 12 μm, 10 μm, 8 μm) and another portion exhibiting at least one relatively smaller size (e.g., 6 μm, 5 μm, 4 μm, 3 μm, 2 μm, 1 μm, 0.5 μm, less than 0.5 μm, 0.1 μm, less than 0.1 μm). In an embodiment, the diamond particles may include a portion exhibiting a relatively larger size between about 10 μm and about 40 μm and another portion exhibiting a relatively smaller size between about 1 μm and about 4 μm. In some embodiments, the diamond particles may comprise three or more different sizes (e.g., one relatively larger size and two or more relatively smaller sizes), without limitation. Upon HPHT sintering the diamond particles to form the polycrystalline diamond, the polycrystalline diamond may, in some cases, exhibit an average grain size that is the same or similar to any of the diamond particles sizes and distributions discussed above. Additionally, in any of the embodiments disclosed herein, the cutting elements 214 may be free-standing (e.g., substrateless) and formed from a polycrystalline diamond body that is at least partially or fully leached to remove a metal-solvent catalyst initially used to sinter the polycrystalline diamond body. In an embodiment, the leached polycrystalline diamond body may be formed to exhibit a porosity of about 1%-10% by volume. Optionally, the leached pores of the polycrystalline diamond body may be impregnated with lubricant to assist in minimizing friction caused by contact of rock materials on the cutter assembly 200. In other embodiments, the polycrystalline diamond body may exhibit a selected porosity that is higher or lower.

The backing portion 218 may similarly be formed from any number of different materials, and may be integrally formed with, or otherwise bonded or connected to, the superabrasive body 216. Materials suitable for the backing portion 218 may include, without limitation, carbon steel, high tensile strength steel, cemented carbides, such as tungsten carbide, titanium carbide, chromium carbide, niobium carbide, tantalum carbide, Invar, vanadium carbide, or combinations thereof cemented with iron, nickel, cobalt, or alloys thereof. For example, in an embodiment, the backing portion 218 comprises cobalt-cemented tungsten carbide. However, in certain embodiments, the superabrasive body 216 may be omitted, and each cutting element may be made from a superabrasive material, such as cemented tungsten carbide. In other embodiments, the backing portion 218 may be omitted and the cutting element may substantially entirely be a superabrasive material, such as a PCD body that has been leached to deplete metal-solvent catalyst therefrom or may be an unleached PCD body.

A cutting surface is a substantially continuous or discontinuous surface or surfaces that are configured to contact and cut a target surface or a tunnel face. In an embodiment, the cutting elements 214 may be sized and configured to form a superabrasive cutting surface or cutting edge. For example, the cutting elements 214 may be positioned such that at least a portion of the working upper surface 216A of each cutting element 214 projects beyond the crest 210 of the cutter ring 202. By forming the cutting surface with the superabrasive bodies 216, deformation of the cutter ring 202, wear of the cutter assembly 200, and/or risk of fatigue may be reduced because the materials (e.g. rock) being cut by the cutter assembly 200 generally contact the cutting elements 214 rather than the cutter ring 202. Moreover, fatigue of the cutter assembly 200 at the contact surface between the superabrasive bodies 216 and the materials being cut may be reduced because the superabrasive bodies 216 do not deform as much as a traditional cutting surface (i.e., steel) due to the superabrasive material's high modulus of elasticity. For example, in an embodiment, the superabrasive body 216 may exhibit a modulus of elasticity between about 800 GPa and about 1200 GPa (e.g., about 800 GPa to about 850 GPa). In other embodiments, the superabrasive body 216 may exhibit a modulus of elasticity greater than about 800 GPa. In other embodiments, the superabrasive body 216 may exhibit a selected modulus of elasticity that is higher or lower. In an embodiment, the cutting elements 214 may enhance the general load capacity of the cutter assembly 200. Further, the cutting elements 214 may form a cutting surface that is more abrasive and resistant to corrosion than a traditional cutting surface (i.e., steel). Optionally, a relatively high thermal conductivity of the cutting elements 214 may also help reduce adhesive wear and resulting scuffing of the cutter ring 202. For example, the superabrasive cutting surface may exhibit a thermal conductivity of about 543 W/m-K, which is about twelve (12) times the thermal conductivity of steel. In other embodiments, the superabrasive cutting surface may exhibit a thermal conductivity of at least about 300 W/m-K; at least about 800 W/m-K; at least about 1300 W/m-K; or at least about 2000 W/m-K. In addition, the superabrasive cutting surface may exhibit a thermal conductivity of about 300 W/m-K to about 2000 W/m-K; about 700 W/m-K to about 1600 W/m-K; or about 1000 W/m-K to about 1300 W/m-K. In other embodiments, the thermal conductivity of the superabrasive cutting surface may be larger or smaller. Accordingly, heat generated by eventual skidding and/or slipping of the cutting elements 214 on rock materials may be quickly conducted away from the cutter ring 202. In other embodiments, the superabrasive cutting surfaces may exhibit thermal conductivities that are higher or lower.

Figure 2B:
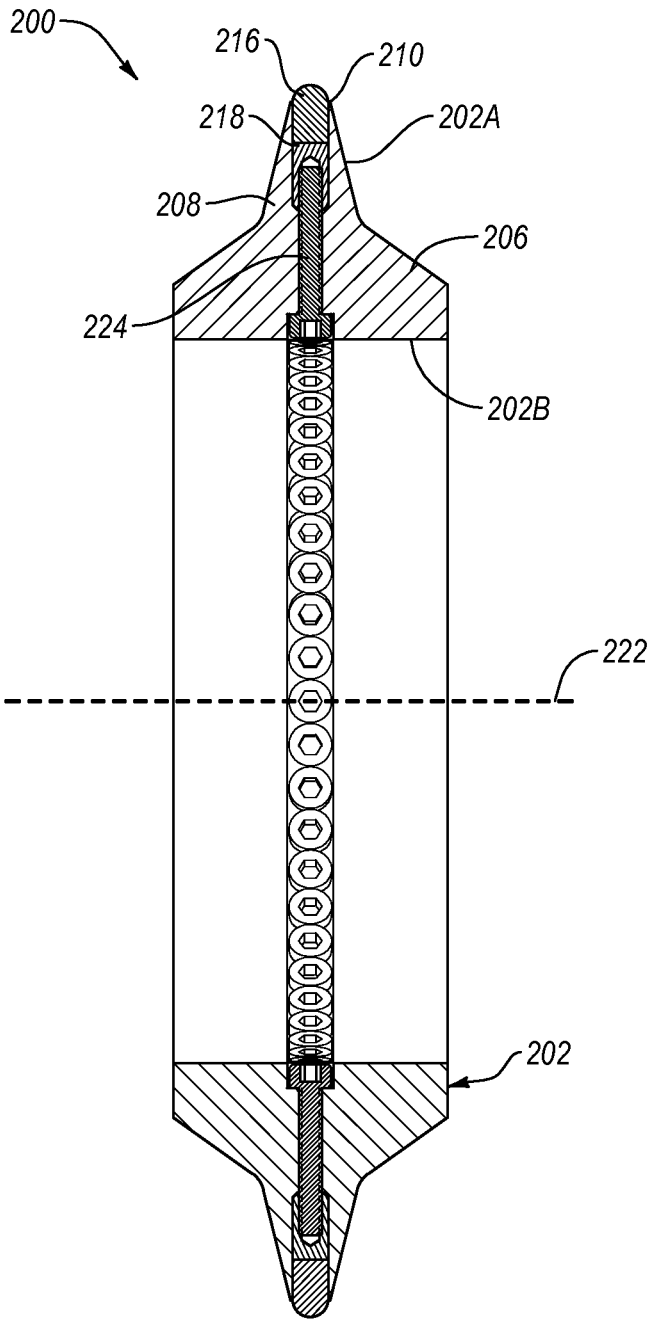
FIG. 2B is a cross-sectional view taken along line 2B-2B of the cutter assembly shown in FIG. 2A.
Figure 2C:
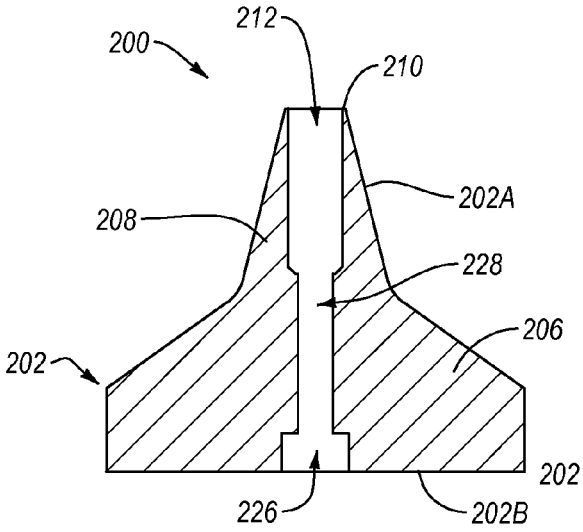
FIG. 2C is a partial, cross-sectional view of the cutter assembly shown in FIG. 2B with a cutting element removed.
Figure 2D:
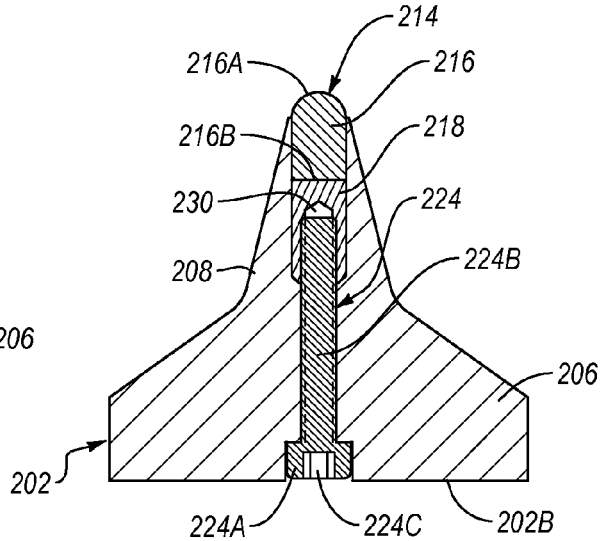
FIG. 2D is a partial, cross-sectional view of the cutter assembly shown in FIG. 2C with the cutting element attached.
Figure 2E:
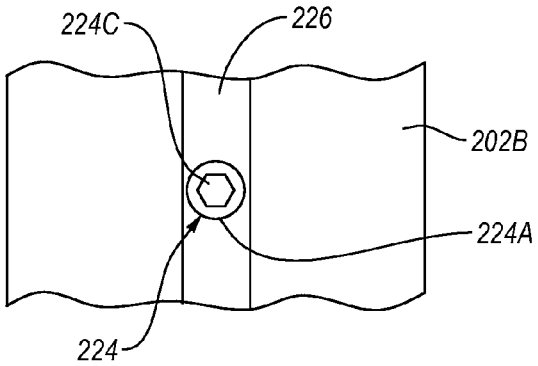
FIG. 2E is a partial, bottom view of the cutter assembly shown in FIG. 2A.

The cutting elements 214 may be mounted or otherwise attached to the cutter ring 202 in any suitable manner. For example, the cutting elements 214 may be attached to the cutter ring 202 via brazing, press-fitting, threadedly attaching, fastening with a fastener, combinations of the foregoing, or any other suitable technique. In an embodiment, the cutting elements 214 may be attached to the cutter ring 202 via a plurality of fasteners 224 inserted from the inside of the cutter ring as shown in FIG. 2B. Referring to FIG. 2D, each fastener 224 may include a head portion 224A and a shank 224B having an outer threaded portion. The shank 224B may be fully threaded or partially threaded. The fasteners 224 may be made from a variety of different materials. For example, the fasteners 224 may comprise a metal, alloy steel, a metal alloy, carbon steel, high strength tensile strength steel, stainless steel, tungsten carbide, or any other suitable metal or conductive or non-conductive material.

In an embodiment, the fasteners 224 may extend from the inner surface 202B of the cutter ring 202 such that the shanks 224B extend through the through holes 228 and the head portions 224A are recessed within the recessed channel 226 or flush with the inner surface 202B of the cutter ring 202. In an embodiment, a bearing surface of the head portions 224A may be configured to engage a portion of the cutter ring 202 within the recessed channel 226 around the through holes 228. The cutting elements 214 may include an aperture 230 having an inner threaded portion configured to rotatably engage at least a portion of the outer threaded portion of the fastener 224.

In an embodiment, each fastener 224 may be selectively rotated in a first direction relative to the cutting element 214, wherein the fastener 224 is threaded into the aperture 230 of the cutting element 214, and in a second direction relative to the cutting element 214, wherein the fastener 224 is unthreaded from the aperture 230 of the cutting element 214. Such a configuration may allow the cutting elements 214 to be selectively attached to and/or detached from the cutter ring 202 via the fasteners 224. For example, the threaded connection between the fasteners 224 and the cutting elements 214 may facilitate repair and/or removal of the cutting elements 214. Such a configuration may also help reduce stresses in the cutter ring 202 by at least partially concentrating and/or transferring loads exerted on the cutting assembly 200 through the fasteners 224 rather than the cutter ring 202. In addition, because the cutting elements 314 are attached to the cutter ring 202 via the fasteners rather than press-fitting, the cutter ring 202 may be formed from a harder, more abrasive-resistant material to help reduce secondary wear.

In further embodiments, the torque applied between the cutting elements 214 and the fasteners 224 may be specified and/or monitored when assembly the cutting assembly 200 for repeatability during manufacture and/or to help prevent overloading the cutting elements 214 and/or fasteners 224. For example, the torque may be about 10 to about 150 foot-pounds ("ft·lbs"), such as about 10 ft·lbs to about 90 ft·lbs, about 50 ft·lbs to about 85 ft·lbs, or about 75 ft·lbs to about 100 ft·lbs.

The fasteners 224 may be sized and/or configured in any suitable manner. For example, the fasteners 224 may exhibit a length sized and configured to correspond to the distance between the recessed channel 226 and a bottom of the aperture 230. In other embodiments, the shank 224B of the fasteners 224 may exhibit an outer diameter configured to generally correspond to the diameter of the through hole 228 and/or the aperture 230. In yet other embodiments, the length, the thread design, and/or outer diameter of the fasteners 224 may be sized and configured to vary the mechanical properties of the fasteners 24.

Optionally, the fasteners 224 may include one or more features configured to facilitate rotation of the fasteners 224 relative to the cutting elements 214. For example, the head portion 224A may include one or more driving recesses configured to help rotate the fastener 224. In an embodiment, one or more of the fasteners 224 may include a hexagonal driving recess 224C configured to receive a tool (e.g., hexagonal wrench) such that a user may rotate the fasteners 224 in the first and second directions. In other embodiments, the head portion 224A may include other types of driving recesses 224C or protrusions that may facilitate applying torque between the fasteners 224 and the cutting elements 214. For example, the head portion 224A may include a driving slot that may be used to help thread the cutting element 214 and fastener 224 together, using, for example, a screwdriver.

Figure 2F:
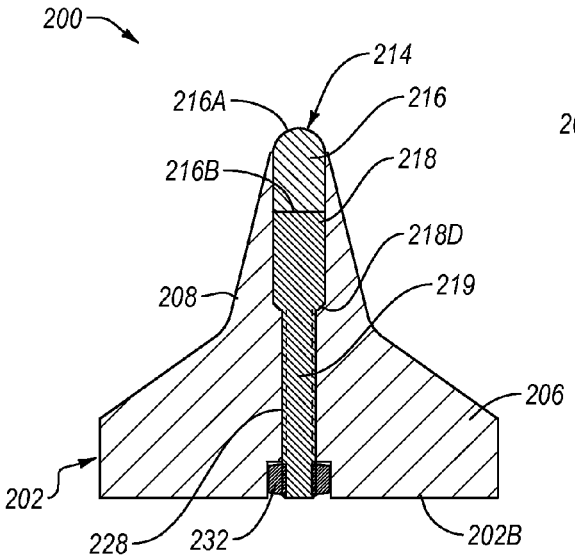
FIG. 2F is a partial, cross-sectional view of the cutter assembly shown in FIG. 2B according to another embodiment.
Figure 2G:
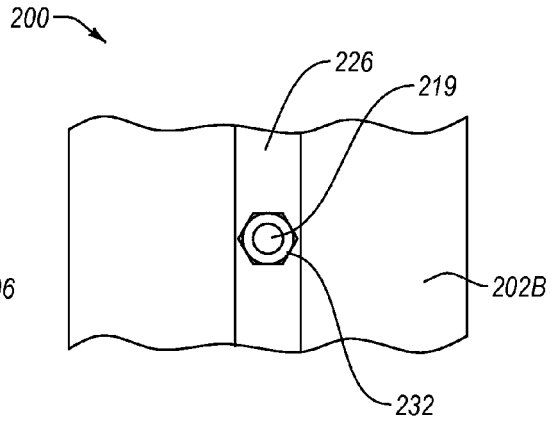
FIG. 2G is a partial, bottom view of the cutter assembly shown in FIG. 2F.

In other embodiments, the cutting elements 214 may include other attachment features configured to help attach the cutting elements 214 to the cutter ring 202. FIGS. 2F and 2G illustrate partial, cross-sectional and bottom views, respectively, of the cutting assembly 200 according to another embodiment. As shown, the backing portions 218 of each cutting element 214 may include an integrally formed shank 219 extending therefrom. The shank 219 may have an outer diameter that is less than an outer diameter of the backing portion 218 such that a shoulder portion 218D is formed between the periphery of the backing portion 218 and the shank 218B. In an embodiment, the shoulder portion 218D may be configured to engage a portion of the cutter ring 202 surrounding the through hole 228 within the pocket 212 (shown in FIG. 2C).

At least a portion of the shank 219 may extend through the through hole 228 and into the recessed channel 226. In an embodiment, the shank 219 of the may include an outer threaded portion. The shank 219 may be fully or partially threaded. As shown, an inner-threaded member 232 (e.g., a threaded nut), including an opening having an inner threaded portion may be selectively threaded onto the shank 219 within the recessed channel 226 to attach the cutting element 214 to the cutter ring 202. A bearing surface of the inner-threaded member 232 may be configured to engage a portion of the cutter ring 202 within the recessed channel 226 around the through holes 228. By selectively threading and unthreading the inner-threaded member 232 from the shank 219, the cutting element 214 may be selectively removed from and/or attached to the cutter ring 202. Optionally, a washer-like member may be positioned between the bearing surface of the inner-threaded member 232 and the cutter ring 202 within the recessed channel 226 to help distribute forces exerted on the cutter ring 202 by the inner-threaded member 232.

Figure 2H:
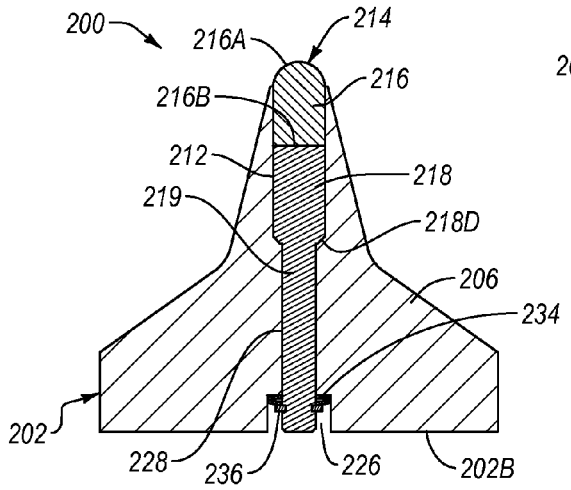
FIG. 2H is a partial, cross-sectional view of the cutter assembly shown in FIG. 2B according to another embodiment.
Figure 2I:
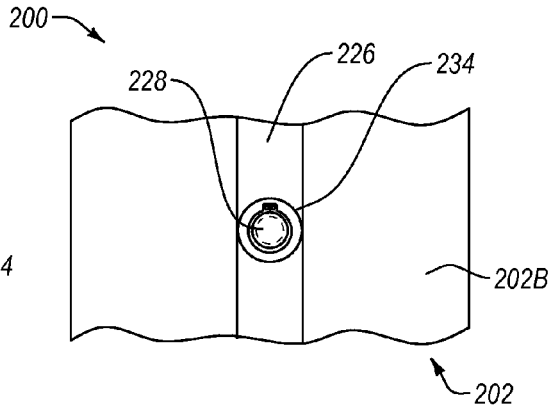
FIG. 2I is a partial, bottom view of the cutter assembly shown in FIG. 2H.

FIGS. 2H and 2I illustrate partial, cross-sectional and bottom views, respectively, of the cutting assembly 200 according to another embodiment. Similar to FIG. 2F, the backing portion 218 of the cutting element 214 may include an integrally formed shank 219 that extends through the through hole 228 and into the recessed channel 226. The shank 219 may be substantially without threads. Optionally, a spring or locking type washer 234 including an opening may be selectively positioned on the shank 218B within the recessed channel 226. The washer 234 may comprise a conical spring washer, a wave washer, a split washer, a spring lock washer, a toothed lock washer, combinations thereof, or any other suitable type of washer. The washer 234 may include a bearing surface configured to engage a portion of the cutter ring 202 within the recessed channel 226 around the through holes 228. A retaining member 236 may be selectively positioned within a groove formed on the shank 219. For example, the retaining member 236 may comprise a retaining ring, a pin (e.g., a cotter pin), a snap ring, a c-clip, or any other non-threaded fastening member. In an embodiment, the washer 234 may be positioned between the cutter ring 202 and the retaining member 236. The retaining member 236 may be configured to help affix the shank 219 to the base portion 206. While one washer 234 is shown, in other embodiments, zero, two, three, four, or any other number of washers 234 may be stacked on the shank 219. In addition, one or more different types of washers 234 may be stacked on the shank 219. For example, a split washer 234 and a wave washer 234 may be stacked on the shank 219 between the cutter ring 202 and the retaining member 236. Such a configuration may facilitate removal and/or attachment of the cutting elements 214 to the cutter ring 202.

Figure 2J:
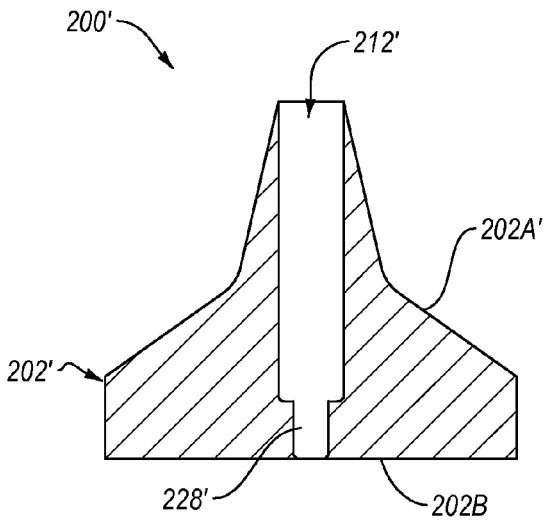
FIG. 2J is a partial, cross-sectional view of the cutter assembly shown in FIG. 2B with a cutting element removed according to another embodiment.
Figure 2K:
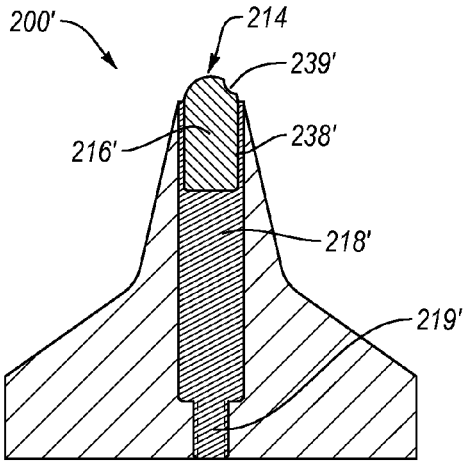
FIG. 2K is a partial, cross-sectional view of the cutter assembly shown in FIG. 2J with the cutting element attached.
Figure 2L:
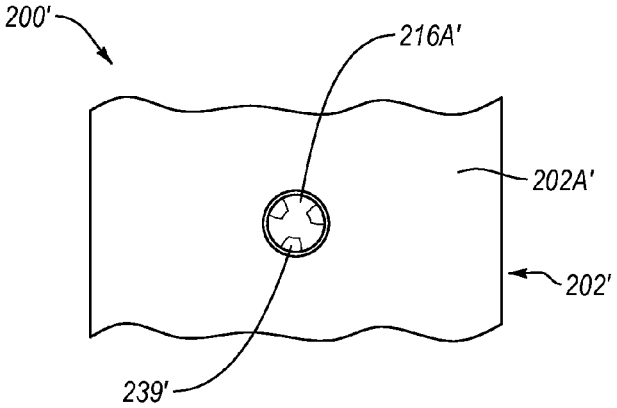
FIG. 2L is a partial, top view of the cutter assembly shown in FIG. 2J.

FIGS. 2J through 2L illustrate partial, cross-sectional views and a top view, respectively, of a cutting assembly 200' according to another embodiment. As shown, the backing portion 218' may include a recess 238' formed therein. The superabrasive body 216' may be partially disposed in the recess 238' and secured partially therein via brazing, press-fitting, threadly attaching, fastening with a fastener, combinations of the foregoing, or any other suitable technique. In an embodiment, the backing portion 218' may include an elongated main body and a shank 219' with an outer threaded portion extending from the main body.

The pockets 212' may be sized and configured to substantially receive the main body of the cutting element 214'. Optionally, the recessed channel may be omitted. For example, the through holes 228' may extend between the pockets 212' and the inner surface 202B'. In other embodiments, the through holes 228' may extend only a portion of a distance between the pockets 212' and the inner surface 202B'. In an embodiment, the through holes 228' may include an inner threaded portion configured to rotatably engage at least a portion of the outer threaded portion of the shank 219'.

In an embodiment, to attach the cutting element 214' to the cutting assembly 200', the cutting element 214' may be selectively rotated in a first direction relative to the through hole 228', wherein the shank 219' is threaded into the through hole 228', and in a second direction relative to the through hole 228', wherein the shank 219' is unthreaded from the through hole 228'. Such a configuration may facilitate repair and/or removal of the cutting elements 214'. In addition, such a configuration may help reduce stresses in the cutter ring 202' by at least partially concentrating and/or directing loads exerted on the cutting assembly 200' through the cutting element 214' rather than the cutter ring 202'.

Optionally, the cutting elements 214' may include one or more features configured to facilitate rotation of the cutting elements 214' relative to the cutter ring 202'. For example, as shown in FIG. 2L, the working upper surface 216A' of the superabrasive body 216' may include a plurality of driving recesses 239' formed therein that may facilitate rotation of the cutting element 214' with a tool or by hand. In other embodiments, the working upper surface 216A' may include one or more protrusions, slots, or any suitable shaped feature configured to transmit a torque or to receive a tool to rotate or thread the cutting element 214' in the cutter ring 202'.

Figure 2M:
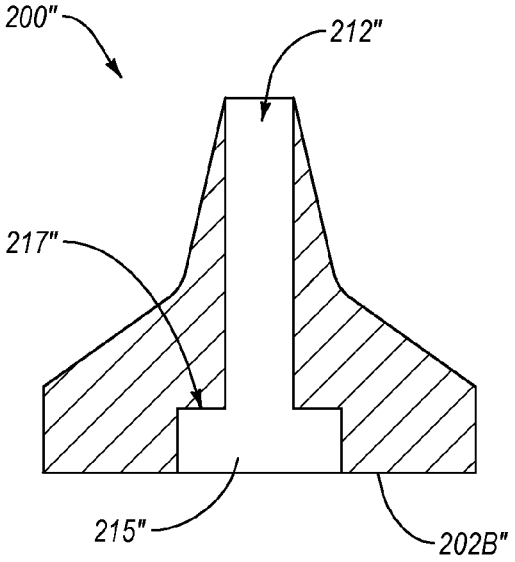
FIG. 2M is a partial, cross-sectional view of a cutter assembly with a cutting element removed according to another embodiment.
Figure 2N:
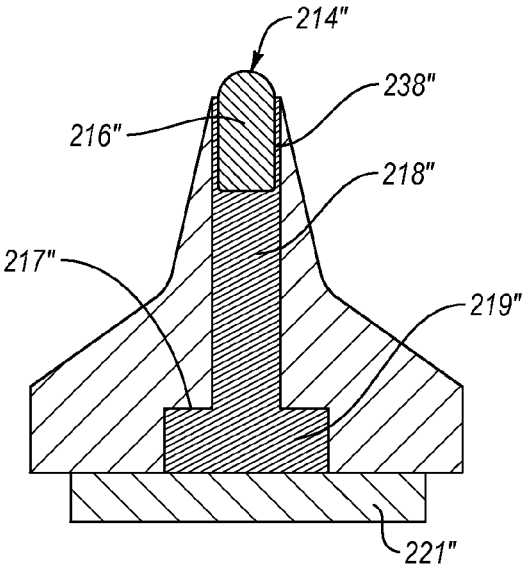
FIG. 2N is a partial, cross-sectional view of the cutter assembly shown in FIG. 2M with the cutting element attached.

FIGS. 2M and 2N illustrate partial, cross-sectional views of a cutting assembly 200" according to another embodiment. As shown, the backing portion 218" may include a recess 238" formed therein. The superabrasive body 216" may be partially disposed in the recess 238" and secured partially therein via brazing, press-fitting, threadly attaching, fastening with a fastener, combinations of the foregoing, or any other suitable technique. In an embodiment, the backing portion 218" may include an elongated main body and a head portion 219" generally opposite the recess 238".

The pockets 212" may be sized and configured to substantially receive the elongated main body and the cutting element 214". In an embodiment, one or more recesses 215" may extend between the pockets 212" and the inner surface 202B" of the cutter ring 202". The one or more recesses 215" may be sized and configured to substantially receive the head portion 219" of the cutting element 214". For example, the pocket 212" may have an outer diameter that is less than an outer diameter of the recess 215" such that a shoulder portion 217" is disposed between the periphery of the pocket 212" and the recess 215". In an embodiment, the one or more recesses 215" may comprise the recessed channel 226 (FIG. 2C). In other embodiments, the one or more recesses 215" may comprise a plurality of recesses 215" circumferentially distributed about the axis 222.

In an embodiment, the cutting element 214" may extend from the inner surface 202B" of the cutter ring 202" such that the main body of the backing portion 218" extends through the pocket 212" and the head portion 219" is recessed within the recess 215" or flush with the inner surface 202B" of the cutter ring 202". In an embodiment, a bearing surface of the head portion 219" may be configured to engage at least a portion of the shoulder portion 217".

In an embodiment, to attach the cutting element 214" to the cutting assembly 200", the cutting element 214" may be inserted from the inner surface 202B" of the cutter ring 202" such that the main body of the backing portion 218" extends through the pocket 212" and the head portion 219" of the backing portion 218" is positioned within the recess 215". A capture element 221" may then be attached to the inner surface 202B" of the cutter ring 202" to retain the cutting element 214" in the pocket 212". In an embodiment, the capture element 221" may comprise an inner ring member selectively attachable to the inner surface 202B" of the cutter ring 202". In other embodiments, the capture element 221" may comprise a plate member, a plug-type member, a cap-type member, a fastener, a pin member, or one or more members capable of capturing the cutting element 214" in the pockets 212".

Figure 3A:
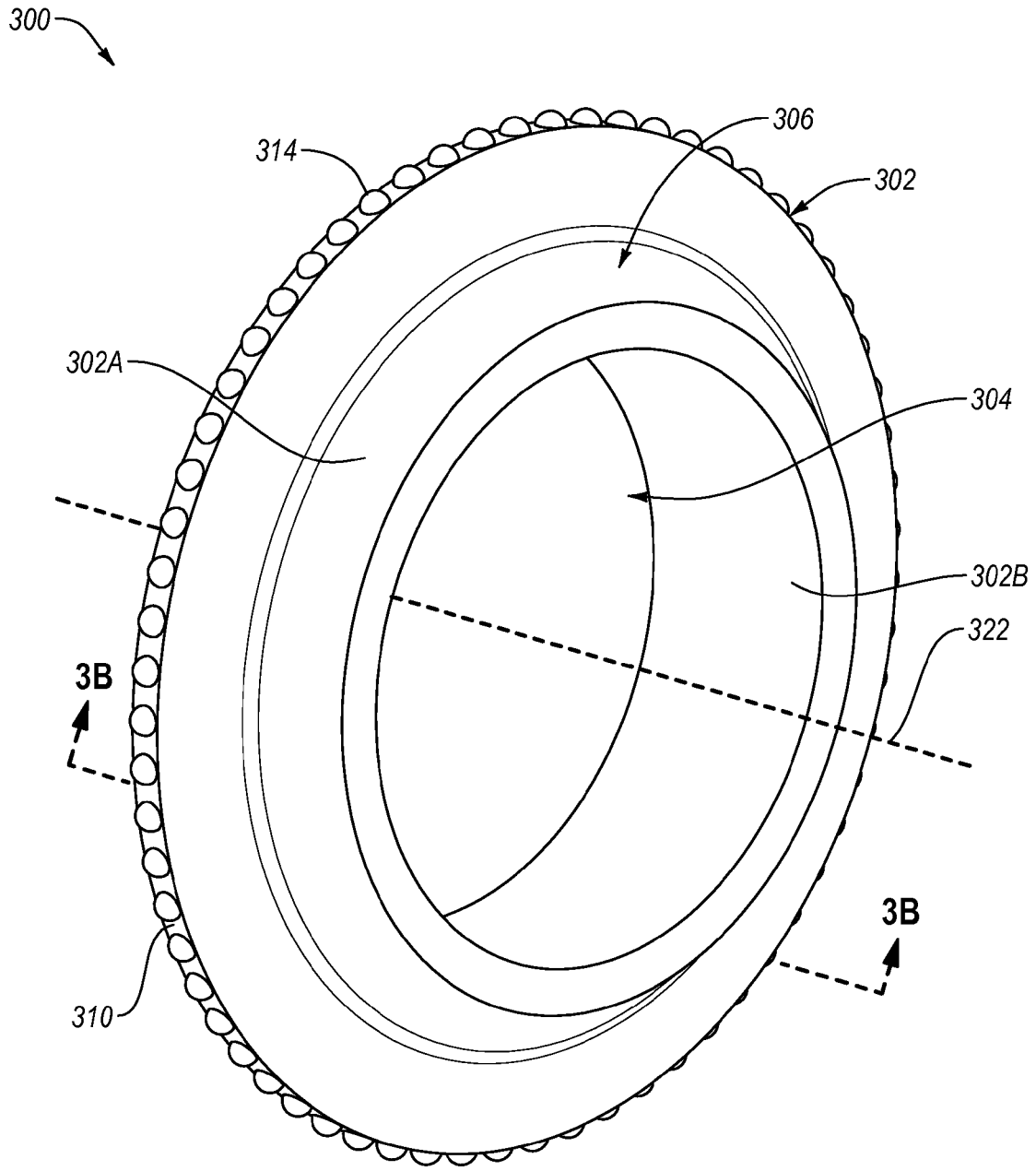
FIG. 3A is an isometric view of a cutter assembly according to an embodiment.
Figure 3B:
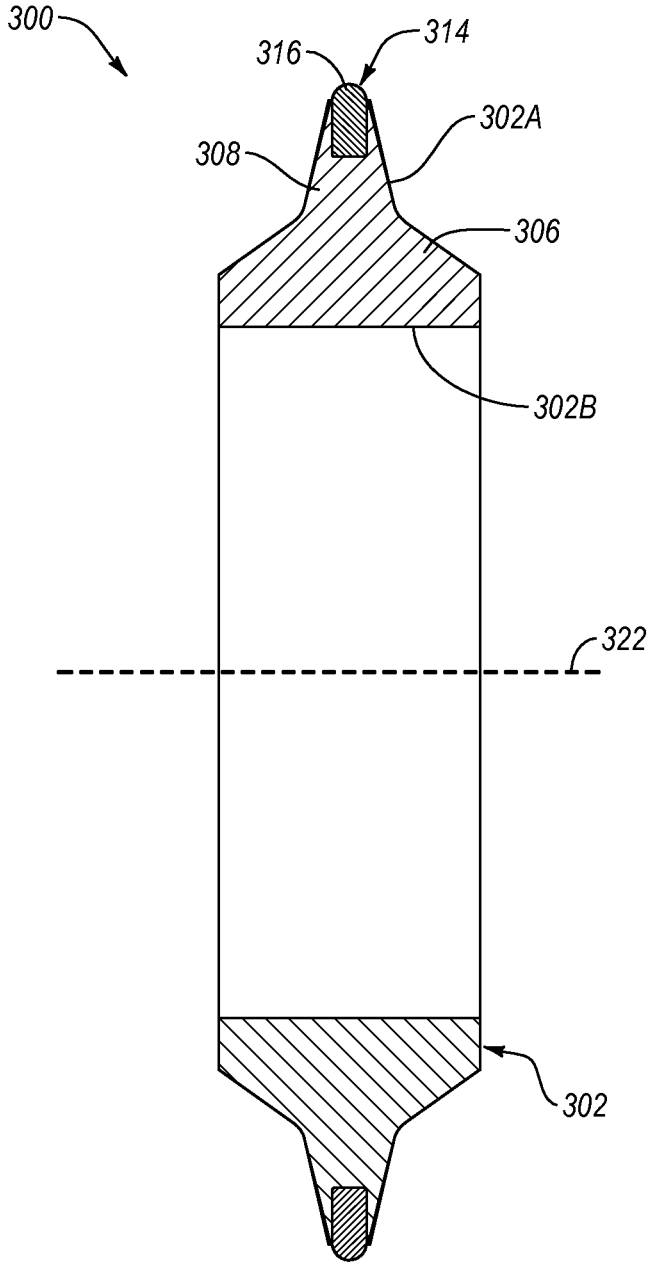
FIG. 3B is a cross-sectional view taken along line 3B-3B of the cutter assembly shown in FIG. 3A.
Figure 3C:
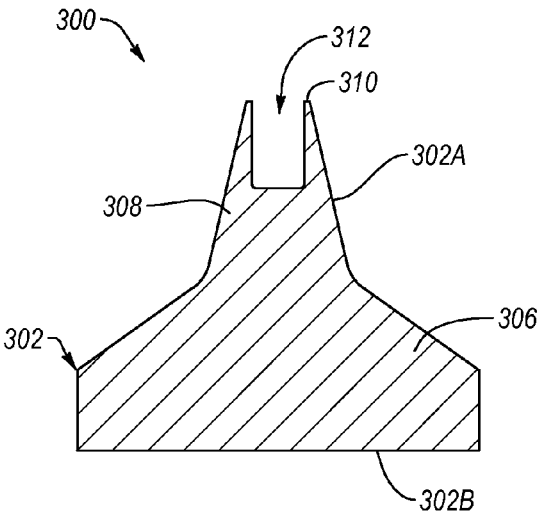
FIG. 3C is a partial, cross-sectional view of the cutter assembly shown in FIG. 3B with a cutting element removed.
Figure 3D:
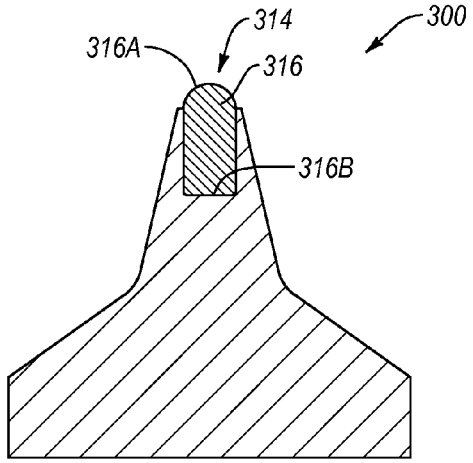
FIG. 3D is a partial, cross-sectional view of the cutter assembly shown in FIG. 3B with the cutting element attached.

The cutting elements may be attached to the cutter ring via a variety of different techniques. For example, FIGS. 3A through 3D illustrate a cutter assembly 300 according to another embodiment. It should be noted that the principles of the cutter assembly 300 may be employed with any of the embodiments described with respect to FIGS. 1 through 2L and vice versa. Referring to FIG. 3A, the cutter assembly 300 may include a cutter ring 302 having an outer surface 302A and an inner surface 302B defining an opening 304 through which a shaft (not shown) may extend. The cutter ring 302 may be made from a variety of different materials. For example, the cutter ring 302 may comprise a metal, alloy steel, a metal alloy, carbon steel, stainless steel, tungsten carbide, combinations thereof, or any other suitable metal or conductive or non-conductive material. The cutter ring 302 may exhibit any suitable geometric shape. For example, the cutter ring 302 may comprise an annular ring including a wedge-like cross-sectional shape and may include a base portion 306 from which a pair of side portions 308 extend and converge to define a crest 310. A plurality of pockets 312 (shown in FIG. 3C) may be formed in the crest 310 and distributed about a rotation axis 322. In an embodiment, the pockets 312 may be distributed in a single row about the rotation axis 322. In other embodiments, the pockets 312 may be distributed in two, three, four, or any other suitable number of rows.

While the cutter ring 302 is illustrated exhibiting a generally wedge-like cross-sectional shape, the cutter ring 302 may exhibit any suitable cross-sectional geometric shape. For example, the cutter ring 302 may exhibit a constant diameter cross-sectional shape, a bell-like cross-sectional shape, a generally domed cross-sectional shape, a generally conical cross-sectional shape, a generally rectangular cross-sectional shape, an asymmetric cross-sectional shape, a generally triangular cross-sectional shape, a generally trapezoidal cross-sectional shape, oval, circular, combinations thereof, or any other suitable cross-sectional geometric shape.

The cutting assembly 300 may further include a plurality of cutting elements 314. In an embodiment, each cutting element 314 may comprise a superabrasive body 316 (e.g, a PCD body) having a working upper surface 316A and an opposing back surface 316B. Each of the cutting elements 314 may be partially disposed in a corresponding one of the pockets 312 of the cutter ring 302 and secured therein via brazing, press fitting, threadedly attaching, fastening with a fastener, mechanically capturing, or suitable mechanical method.

Figure 3E:
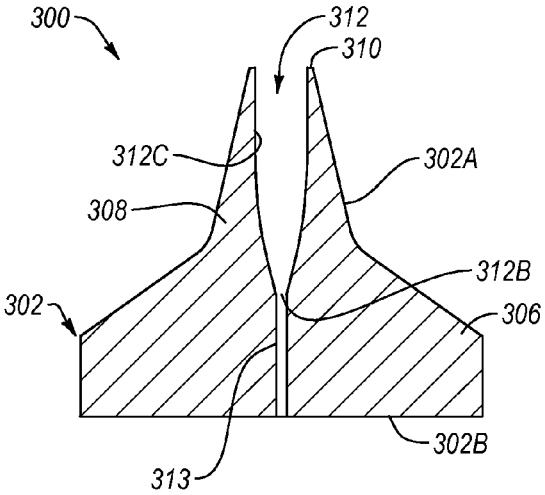
FIG. 3E is a partial, cross-sectional view of the cutter assembly shown in FIG. 3B with a cutting element removed according to another embodiment.
Figure 3F:
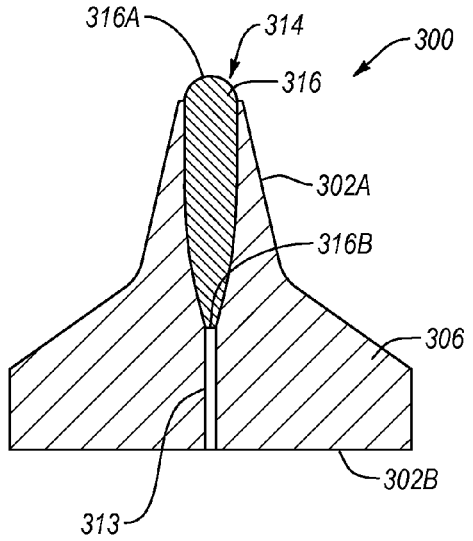
FIG. 3F is a partial, cross-sectional view of the cutter assembly shown in FIG. 3E.
Figure 3G:
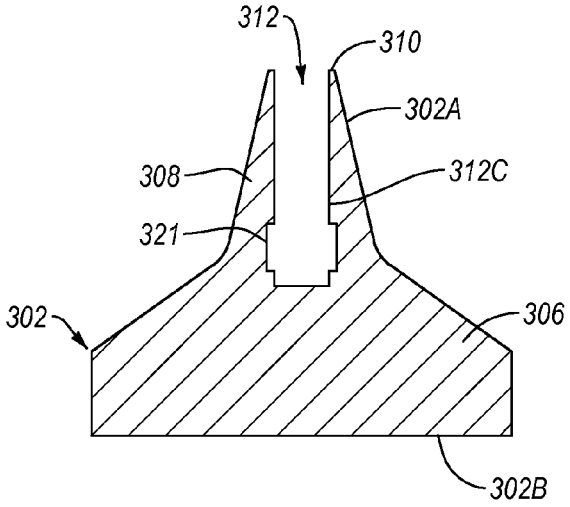
FIG. 3G is a partial, cross-sectional view of the cutter assembly shown in FIG. 3B with a cutting element removed according to another embodiment.
Figure 3H:
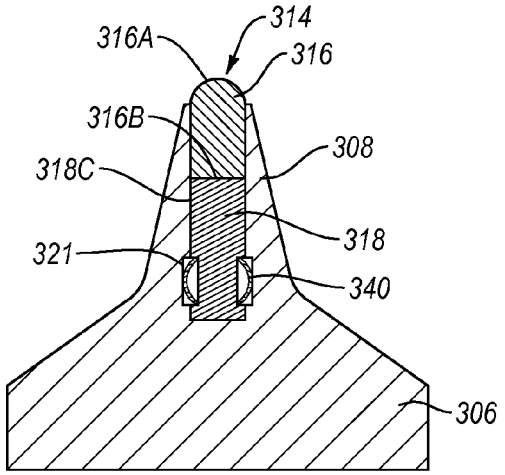
FIG. 3H is a partial, cross-sectional view of the cutter assembly shown in FIG. 3G with the cutting element attached.
Figure 3I:
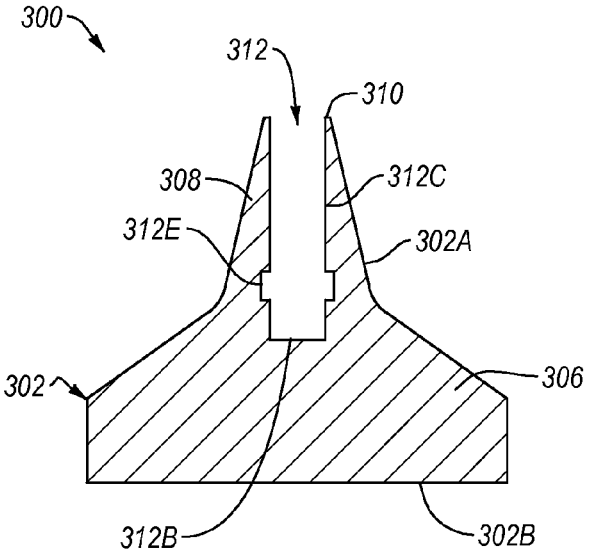
FIG. 3I is a partial, cross-sectional view of the cutter assembly shown in FIG. 3B with a cutting element removed according to another embodiment.
Figure 3J:
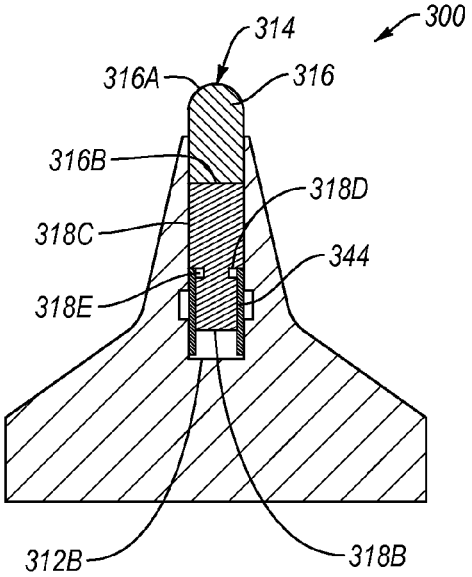
FIG. 3J is a partial, cross-sectional view of the cutter assembly shown in FIG. 3I with the cutting element partially positioned in the pocket.
Figure 3K:
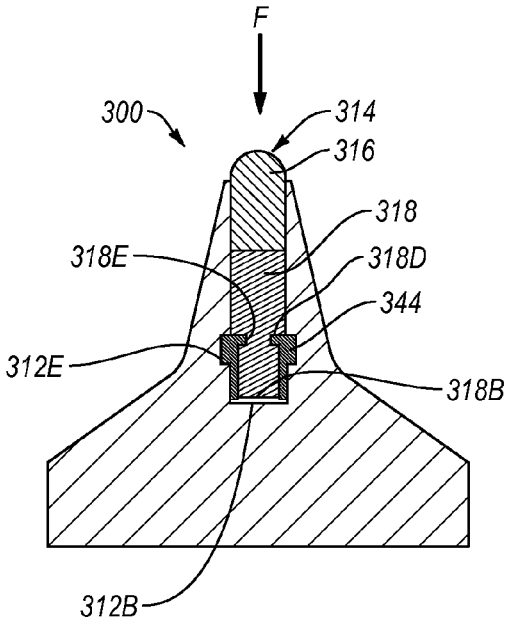
FIG. 3K is a partial, cross-sectional view of the cutter assembly shown in FIG. 3I with the cutting element attached.
Figure 3L:
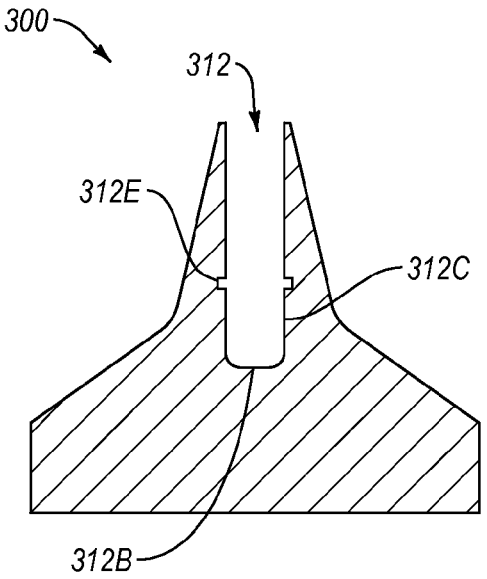
FIG. 3L is a partial, cross-sectional view of the cutter assembly shown in FIG. 3B with a cutting element removed according to another embodiment.
Figure 3M:
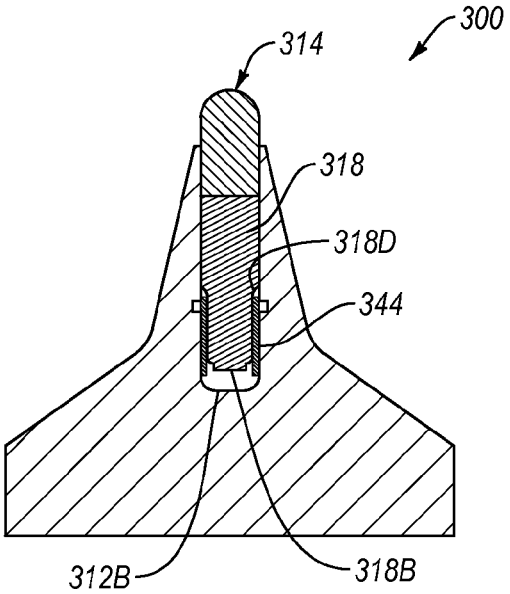
FIG. 3M is a partial, cross-sectional view of the cutter assembly shown in FIG. 3L with the cutting element partially positioned in the pocket.
Figure 3N:
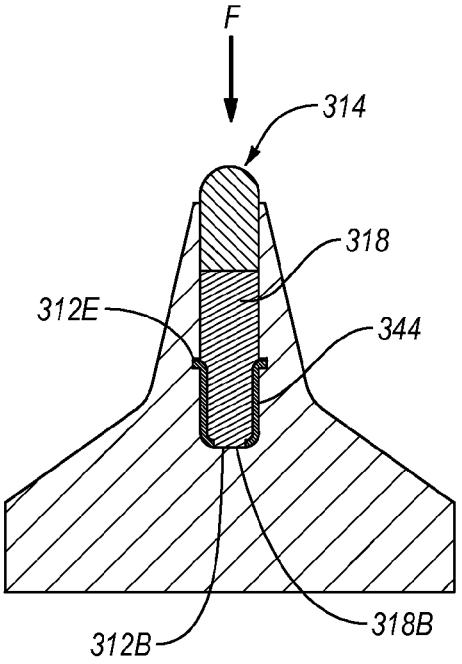
FIG. 3N is a partial, cross-sectional view of the cutter assembly shown in FIG. 3L with the cutting element attached.
Figure 3O:
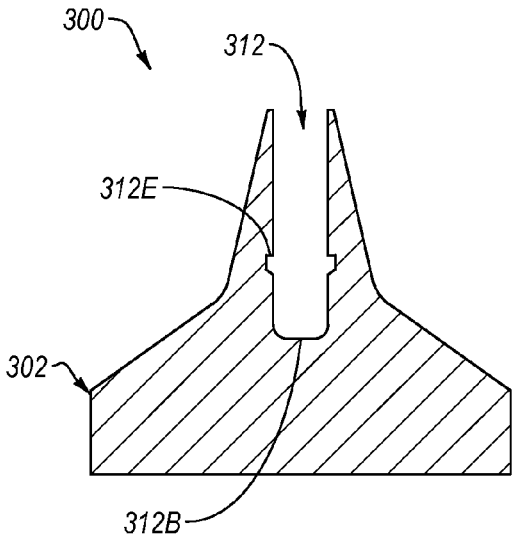
FIG. 3O is a partial, cross-sectional view of the cutter assembly shown in FIG. 3B with a cutting element removed according to another embodiment.
Figure 3P:
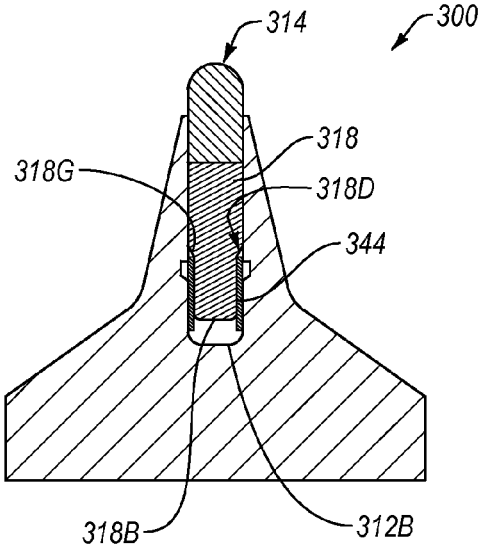
FIG. 3P is a partial, cross-sectional view of the cutter assembly shown in FIG. 3O with the cutting element partially positioned in the pocket.
Figure 3Q:
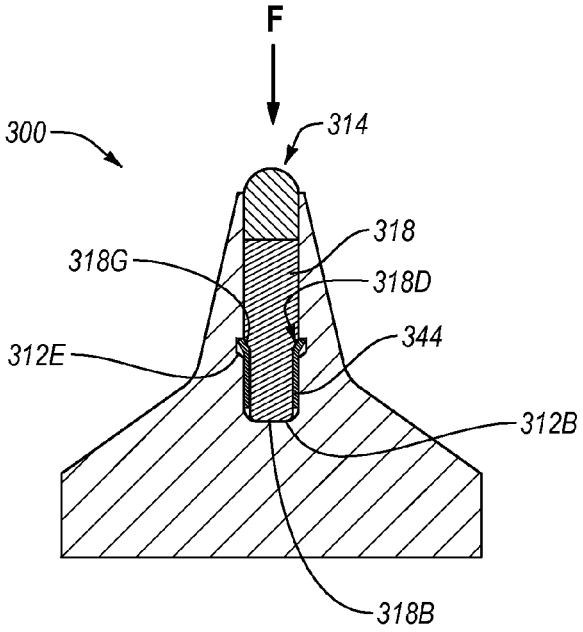
FIG. 3Q is a partial, cross-sectional view of the cutter assembly shown in FIG. 3O with the cutting element attached.
Figure 3R:
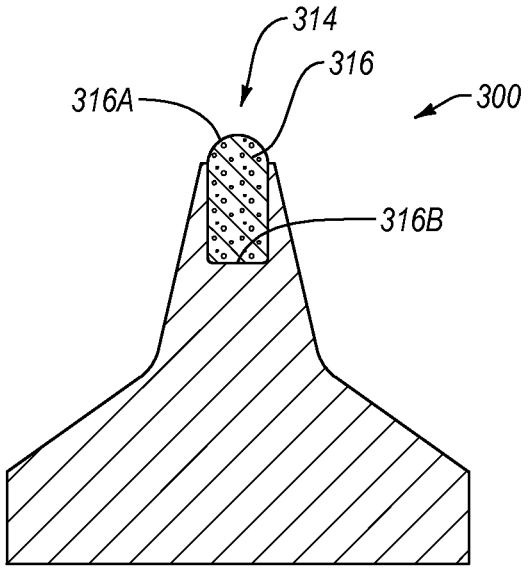
FIG. 3R is a partial, cross-sectional view of the cutter assembly shown in FIG. 3D according to another embodiment.
Figure 3S:
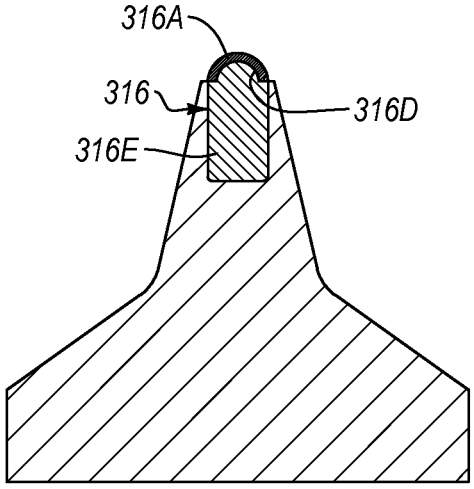
FIG. 3S is a partial, cross-sectional view of the cutter assembly shown in FIG. 3D according to another embodiment.

While the cutting element 314 is illustrated comprising a superabrasive body 316, in other embodiments, the cutting elements 314 may include a superabrasive body 316 bonded or otherwise attached to a backing portion 318. In other embodiments, as shown in FIG. 3R, the superabrasive body 316 may be a PCD body that is substantially fully leached to remove a metal-solvent catalyst initially used to sinter the superabrasive body 316. In yet other embodiments, as shown in FIG. 3S, the superabrasive body 316 may comprise a superabrasive layer 316D (e.g., a PCD layer) bonded or otherwise attached to a substrate 316E (e.g., a cobalt-cemented tungsten carbide substrate).

The cutting elements 314 may be positioned in the pockets 312 such that at least a portion of the working surface 316A of each cutting element 314 projects beyond the crest 310 of the cutter ring 302 to form a cutting surface. Forming the cutting surface with the superabrasive bodies 316 rather than the cutter ring 302, may help reduce deformation of the cutter ring 302, wear of the cutter assembly 300, and/or risk of fatigue. Moreover, fatigue of the cutter assembly 300 at the contact surface between the superabrasive bodies 316 and materials being cut may be reduced because the superabrasive bodies 316 do not deform as much as a traditional cutting surface (i.e., steel) due to the superabrasive material's high modulus of elasticity.

In an embodiment, the cutter assembly 300 may include one or more geometric features configured to help secure the cutting elements 314 in the pockets 312. FIGS. 3E and 3F illustrate partial, cross-sectional views of the cutting assembly 300 according to another embodiment. As shown, a side surface 312C may extend between a pocket opening 312A and the bottom surface 312B of the pocket. In an embodiment, the side surface 312C may be generally elongate relative to a lateral dimension of the opening 312A and/or the bottom surface 312B. In an embodiment, the side surface 312C may exhibit a varying diameter. For example, the side surface 312C may include a first portion exhibiting a generally constant diameter and a second portion between the first portion and the bottom surface 312B of the pocket 312. In an embodiment, the second portion may exhibit a varying diameter that tapers between the first portion and the bottom surface 312B of the pocket 312. Optionally, the cutter ring 302 may include one or more through holes 313 extending between the bottom surface 312B of the pocket 312 and the inner surface 302B of the cutter ring 302. Such a configuration may facilitate removal of the cutting element 314 from the pocket for repair or replacement purposes. For example, in an embodiment, a removal device (e.g., an ejector pin) may be inserted from the inner surface 302B of the cutter ring 302 through the through hole 313 to eject or push the cutting element 314 out of the pocket 312.

In an embodiment, one or more of the cutting elements 314 may comprise a generally elongate superabrasive body 316 (e.g., a PCD body) that includes a tapered portion toward the back surface 316B. As the cutting element 314 is pressed into the pocket 312, the elongated configuration of the pockets 312 and the elongated configured to the cutting elements 314 may help form a generally longitudinal fit (e.g., the cutting element 314 extends a distance below the outer surface 302A of the cutter ring that is greater than a lateral dimension of the pocket 312) between the cutter ring 302 and the cutting elements 314. The longitudinal fit between the cutting elements 314 and the pockets 312 helps reduce the risk of the cutting element 314 being pried or pivoted out of the pocket 312. As the cutting element 314 is further pressed into the pocket 312, the tapered portion of the cutting element 314 may become wedged or taper fitted within the tapered second portion of the pocket 312. Such a configuration may be described, in at least one embodiment, as a "taper-lock" configuration. As the cutting element 314 moves closer to the bottom surface 312B of the pocket 312, a greater compressive force is created between the cutting element 314 and the pocket 312. Such a configuration may help attach or couple the cutting element 312 to the cutter ring 302.

Figure 3T:
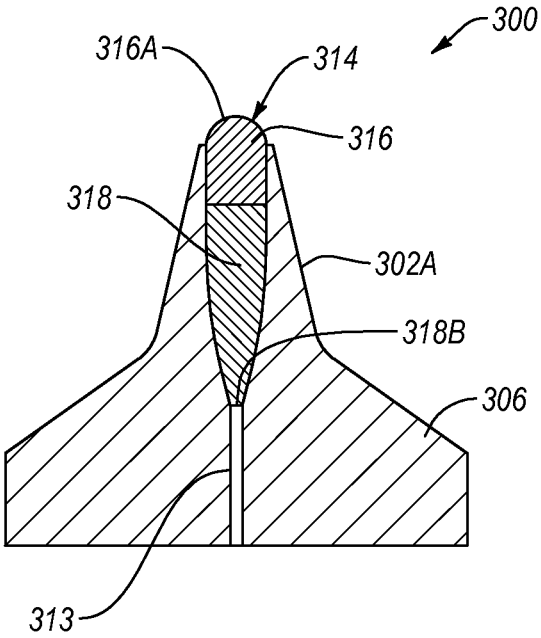
FIG. 3T is a partial cross-sectional view of the cutter assembly shown in FIG. 3F according to another embodiment.

While the cutting element 314 is illustrated comprising a superabrasive body 316, in other embodiments, cutting element 314 may include one or more layers, may include a superabrasive body 316 bonded or otherwise attached to a backing portion, or may exhibit any other suitable configuration. For example, as shown in FIG. 3T, in an embodiment, one or more of the cutting elements 314 may comprise a superabrasive body 316 bonded or otherwise attached to an elongate backing portion 318 that includes a tapered portion 318B.

In other embodiments, the cutter assembly 300 may include one or more of one or more resilient or compressible features configured to help secure the cutting elements 314 in the pockets 312. FIGS. 3G and 3H illustrate partial, cross-sectional views of the cutting assembly 300 according to yet another embodiment. The cutting elements 314 may comprise a superabrasive body 316 (e.g., PCD body) including a working upper surface 316A and an opposing back surface 316B. As shown, the back surface 316B may be bonded or otherwise attached to an elongated backing portion 318. The backing portion 318 may be formed from any number of different materials. Materials suitable for the backing portion 318 may include, without limitation, carbon steel, high tensile strength steel, cemented carbides, such as tungsten carbide, titanium carbide, chromium carbide, niobium carbide, tantalum carbide, Invar (i.e., about 64 weight % iron and about 34 weight % nickel), vanadium carbide, or combinations thereof cemented with iron, nickel, cobalt, or alloys thereof. For example, in an embodiment, the backing portion 318 comprises cobalt-cemented tungsten carbide.

Each of the cutting elements 314 may be partially disposed and secured in a corresponding one of the pockets 312 of the cutter ring 302. In an embodiment, the pockets 312 may be sized and configured such that the backing portions 318 of the cutting elements 314 and the pockets 312 form a generally longitudinal fit. Forming a longitudinal fit between the cutting elements 314 and the pockets 312, may help reduce the risk of the cutting elements being pried or pivoted out of the pockets 312. In an embodiment, the backing portion 318 may include a spring-type retainer 340 positioned within a groove formed in the side surface 318C of the backing portion 318. The spring-type retainer 340 may be configured to help secure or attach the cutting element 314 in the pocket 312. In an embodiment, the spring-type retainer 340 may comprise a snap ring including one or more bands or portions of a generally spherical shell, an elliptical shell, or any other suitable compressible resilient retainer. When the cutting element 314 is inserted into the pocket 312, the side surface 312C of the pockets 312 may force the snap ring 340 toward the side surface 318C of the backing portion 318. In response, the snap ring 340 may resiliently exert an outward force against the side surface 312C of the pockets 312. Optionally, the snap ring 340 may be positionable within one or more grooves or slots 321 formed in the side surface 312C of the pocket 312 to help secure or attach the cutting element 314 in the pocket 312.

While the spring-type retainer 340 is described as a snap ring, in other embodiments, the spring-type retainer 340 may comprise one or more compressible members (e.g., compressible rubber), one or more spring-like bars, one or more wave-like members, one or more retaining rings, a c-clip, a pin, combinations thereof, or the any other suitable retainer member.

In yet other embodiments, the cutter assembly 300 may include one or more elastic and/or plastic deformation locking features configured to help secure the cutting elements 314 in the pockets 312. FIGS. 3I and 3K illustrate partial, cross-sectional views of the cutting assembly 300 according to another embodiment. The cutting element 314 may comprise a superabrasive body (e.g., PCD body) including a working upper surface 316A and an opposing back surface 316B. As shown, the back surface 316B may be bonded or otherwise attached to a backing portion 318 having a bottom surface 318B and a side surface 318C. The backing portion 318 may be formed from any number of different materials. Materials suitable for the backing portion 318 may include, without limitation, carbon steel, high tensile strength steel, cemented carbides, such as tungsten carbide, titanium carbide, chromium carbide, niobium carbide, tantalum carbide, vanadium carbide, or combinations thereof cemented with iron, nickel, cobalt, or alloys thereof. For example, in an embodiment, the backing portion 318 comprises cobalt-cemented tungsten carbide.

In an embodiment, a locking slot or groove 312E may be formed in the side surface 312C of the pocket 312. The groove 312E may extend about at least a portion of the periphery of the pocket 312. In an embodiment, the groove 312E may exhibit a generally rectangular cross-sectional geometry. In other embodiments, the groove 312E may exhibit a generally semi-elliptical cross-sectional geometry, a v-notch like geometry, or any other suitable cross-sectional geometry.

In an embodiment, a deformable locking member 344 may be loaded onto the backing portion 318. The locking member 344 may include any material configured to deform in response to a selected force. For example, in an embodiment, the locking member 344 may include metal, metal alloys, plastic materials, composite materials, polymers, combinations thereof, or any other suitable material. For example, the locking member 344 may include copper, tin, lead, gold, silver, iron, or alloys thereof. The backing portion 318 may include one or more features configured to help position the locking member 344 on the backing portion 318. For example, a portion of the side surface 318C of the backing portion 318 may be recessed or removed such that a shoulder portion 318D is formed on the backing portion 318. Such a configuration may allow the locking member 344 to be positioned on the backing portion 318 such that the locking member 344 is generally flush with or recessed relative to the upper portion of the side surface 318C of the backing portion 318. In an embodiment, the locking member 344 may be sized and configured such that at least a portion of the locking member 344 extends beyond the bottom surface 318B of the backing portion 318. In an embodiment, the backing portion 318 may also include a locking slot or groove 318E formed in the side surface 318C near the shoulder portion 318D.

In an embodiment, the locking member 344 may be moveable between a storage configuration, wherein the locking member 344 exhibits a geometric shape (e.g., generally cylindrical, strips, wireframe, or the like) configured to generally correspond to at least part of the lower portion of the backing portion 318, and a locking configuration, wherein the locking member 344 is plastically deformed in one or more directions to at least partially fill the locking groove 312E of the pocket 312 and the locking groove 318E of the backing portion 318. In other embodiments, a locking feature may be elastically deformed to couple the cutting element 314 to the pocket 312.

The locking member 344 may be moved between the storage and locking configurations in any suitable manner. For example, the cutting element 314 may be positioned in the pocket 312 with the locking member 344 in the storage configuration as shown in FIG. 3J. In an embodiment, at least a portion of the locking member 344 may be positioned between the bottom surface 312B of the pocket 312 and the bottom surface 318B of the backing portion 318. To move the locking member 344 from the storage configuration (shown in FIG. 3J) to the locking configuration (shown in FIG. 3K), a force F may be selectively exerted on the cutting element 314 as shown in FIG. 3K. The magnitude and direction of the force F may be configured such that, as cutting element 314 is forced toward the bottom surface 312B of the pocket 312, the locking member 344 is compressed between the bottom surface 312B of the pocket 312 and the shoulder portion 318D of the backing portion 318. As the locking member 344 is compressed between the bottom surface 312B and the shoulder portion 318D, the locking member 344 may move toward the locking configuration by plastically deforming and at least partially filling the locking grooves 312E and 318E. Accordingly, when the locking member 344 is in the locking configuration, the interface between the pocket 312 and the cutting element 314 may include alternating intermeshed portions of locking member 344, side surface of pocket 312, and side surface of backing portion 314. Such a configuration may help mechanically fasten or hold the cutting element 314 in the pocket 312. While an applied force F is shown moving the locking member 344 from the storage configuration toward the locking configuration, in other embodiments, heating, chemical treatments, pressure, or any other suitable technique may be configured to move from the storage configuration toward the locking configuration.

By varying the size, shape, and/or configuration the locking member 344, the cutting element 314 and/or the pocket 312, the securement between the cutting elements 314 and the pockets 312 may be varied. For example, in an embodiment, the depth of the locking grooves 312E and 318E may be selected to increase the securement between the cutting element 314 and the pocket 312. FIGS. 3L through 3N illustrate partial, cross-sectional views of the cutting assembly 300 according to another embodiment. As shown, the backing portion 318 may include a locking groove 318E formed near the bottom surface 318B. In an embodiment, the shoulder portion 318D of backing portion 318 may include one or more radii, chamfer, or rounded edge, and the pocket 312 may include one or more radii, chamfer, fillet, or concave feature extending between the bottom surface 312B and the side surface 312C. To move the locking member 344 from the storage configuration (shown in FIG. 3M) to the locking configuration (shown in FIG. 3N), a force F may be selectively exerted on the cutting element 314 as shown in FIG. 3N. The magnitude and direction of the force F may be configured such that as the cutting element 314 is forced toward the bottom surface 312B of the pocket 312, the locking member 344 is compressed between the shoulder portion 318D and the radii of the pocket 312 in order to move toward the locking configuration. For example, the curvature of the shoulder portion 318D may be sized and configured to direct or guide the upper end of the locking member 344 into the locking groove 312E as the locking member 344 deforms under the force F. Further, the curvature of the radii of the pocket 312 may be sized and configured to direct or guide the lower end of the locking member 344 into the locking groove 318E between the bottom surface 312B of pocket 312 and the bottom surface 318B of the backing portion 318. Such a configuration may help mechanically couple, fasten or hold the cutting elements 314 in the pockets 312.

In other embodiments, the shoulder portion 318D may include an angled surface. FIGS. 3O through 3Q illustrate partial, cross-sectional views of the cutting assembly 300 according to yet another embodiment. As shown, the shoulder portion 318D may include an angled surface 318G. The locking member 344 may be positioned on the backing portion 318 such that at least a portion of the locking member 344 extends between the bottom surface 312B of the pocket 312 and the bottom surface 318A of the backing portion 318. To move the locking member 344 from the storage configuration (shown in FIG. 3P) to the locking configuration (shown in FIG. 3Q), a force F may be selectively exerted on the cutting element 314 as shown in FIG. 3Q. The magnitude and direction of the force F may be configured such that as the cutting element 314 is forced toward the bottom surface 312B of the pocket 312, the locking member 344 is compressed between the shoulder portion 318D and the bottom surface 312B of the pocket 312 in order to move toward the locking configuration. For example, the angled surface 318G may be sized and configured to direct or guide the upper end of the locking member 344 into the locking groove 312E as the locking member 344 deforms under the force F. Such a configuration may help mechanically couple, fasten, or hold the cutting elements 314 in the pockets 312.

Any of the cutter assemblies described herein may include one or more features extending between the side portions of the cutter ring to help secure the cutting elements in the pockets. For example, FIGS. 4A through 4D illustrate a cutter assembly 400 according to another embodiment. It should be noted that the principles of the cutter assembly 400 may be employed with any of the embodiments described with respect to FIGS. 1 through 3Q and vice versa.

Figure 4A:
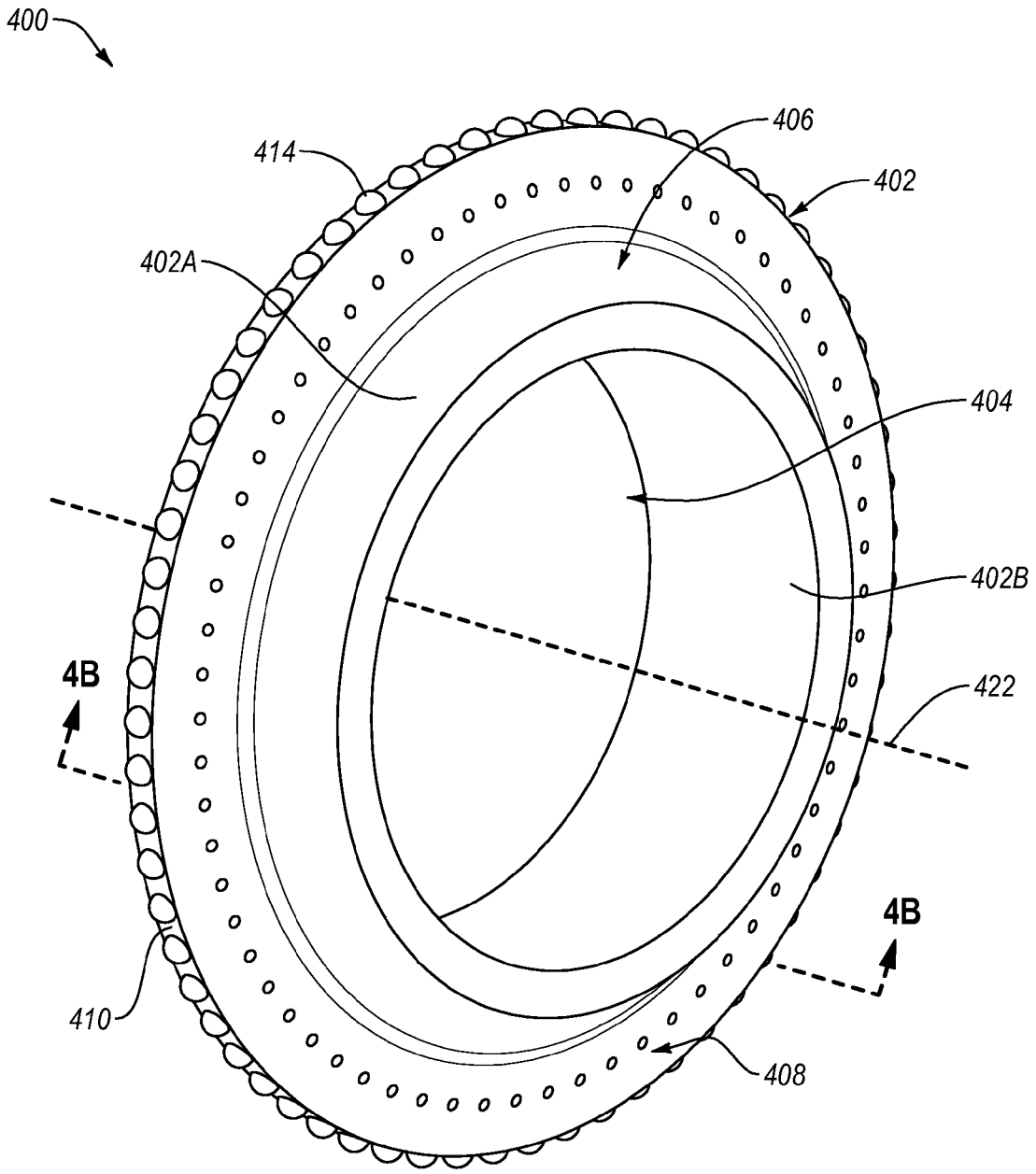
FIG. 4A is an isometric view of a disc cutter according to an embodiment.

Referring to FIG. 4A, the cutter assembly 400 may include a cutter ring 402 having an outer surface 402A and an inner surface 402B defining an opening 404 through which a shaft (not shown) may extend. The cutter ring 402 may be made from a variety of different materials such as, for example, metal, alloy steel, a metal alloy, carbon steel, stainless steel, tungsten carbide, combinations thereof, or any other suitable metal or conductive or non-conductive material. The cutter ring 402 may exhibit any suitable geometric shape. For example, the cutter ring 402 may include a base portion 406 from which a pair of side portions 408 extend and converge to define a continuous crest 410. A plurality of pockets 412 (shown in FIG. 4C) may be formed in the crest and distributed about a rotation axis 422. In an embodiment, the pockets 412 may be distributed in a single row about the rotation axis 422. In other embodiments, the pockets 412 may be distributed in two, three, four, or any other suitable number of rows.

While the cutter ring 402 is illustrated including a base portion and a pair of curved side portions, in other embodiments, the cutter ring 402 may exhibit a generally triangular cross-sectional shape, a generally rectangular shape, a u-like cross-sectional shape, a t-like cross-sectional shape, an asymmetric cross-sectional shape, an L-like cross-sectional shape, combinations thereof, or any other suitable geometric shape.

The cutting assembly 400 may further include a plurality of cutting elements 414. Each of the cutting elements 414 may be partially disposed in a corresponding one of the pockets 412 of the cutter ring 402. Each cutting element 414 may include a superabrasive body 416 having a working upper surface 416A and an opposing back surface 416B. As shown, the superabrasive body 416 may comprise a superabrasive layer 416D (e.g., a PCD layer) bonded or otherwise attached to a substrate 416E (e.g., tungsten carbide). In the illustrated embodiment, the back surface 416B may be bonded or otherwise attached to a backing portion 418. The backing portion 418 may be formed from any number of suitable materials, and may be integrally formed with, or otherwise bonded or connected to, the superabrasive body 416. For example, the backing portion 418 may include, without limitation, carbon steel, high tensile strength steel, cemented carbides, such as tungsten carbide, titanium carbide, chromium carbide, niobium carbide, tantalum carbide, vanadium carbide, or combinations thereof cemented with iron, nickel, cobalt, or alloys thereof.

The cutting elements 414 may be positioned in the pockets 412 such that at least a portion of the working upper surface 416A of each cutting element 414 projects beyond the crest 410 of the cutter ring 402 to form a cutting surface. Forming the cutting surface with the superabrasive cutting elements 414, rather than the cutter ring 402, may help reduce deformation of the cutter ring 402, wear of the cutter assembly 400, and/or risk of fatigue.

Figure 4B:
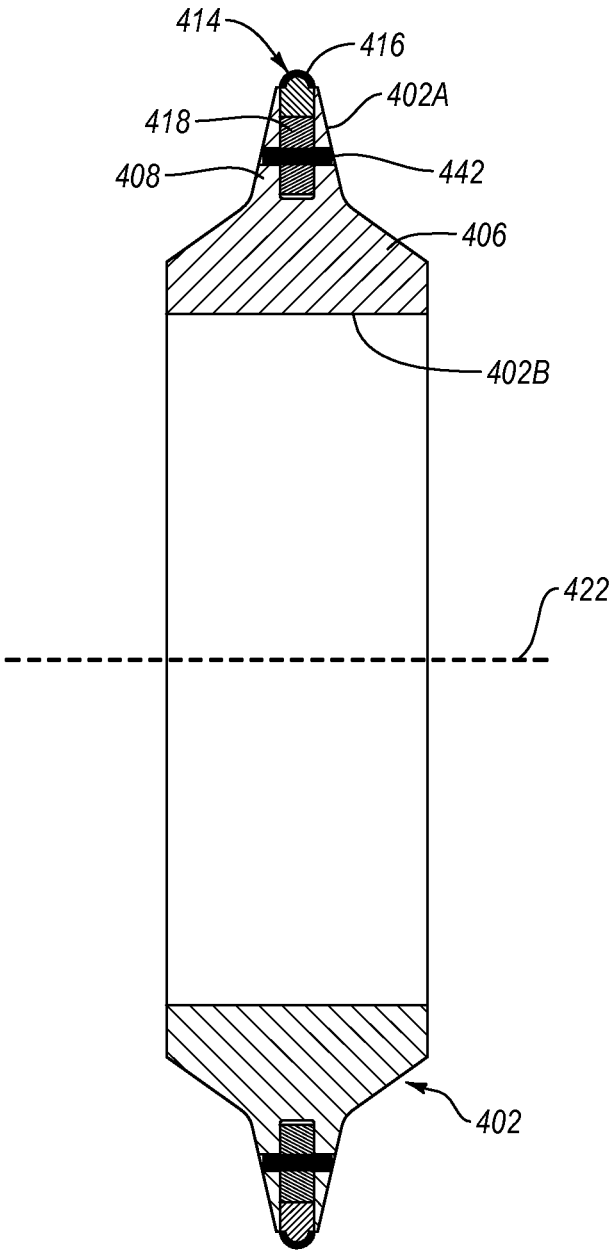
FIG. 4B is a cross-sectional view taken along line 4B-4B of the disc cutter shown in FIG. 4A.
Figure 4C:
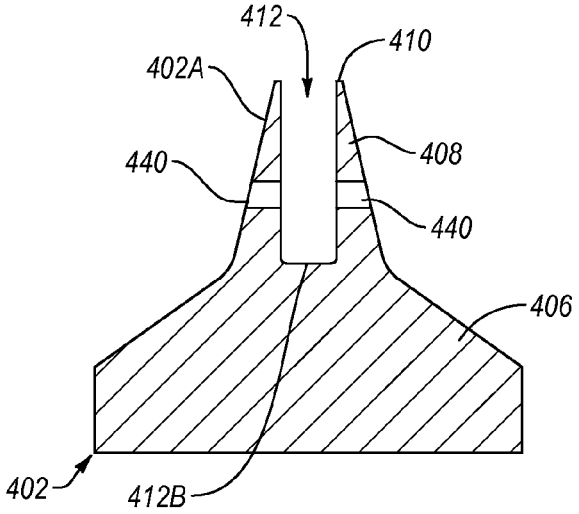
FIG. 4C is a partial, cross-sectional view of the cutter assembly shown in FIG. 4B with a cutting element removed.
Figure 4D:
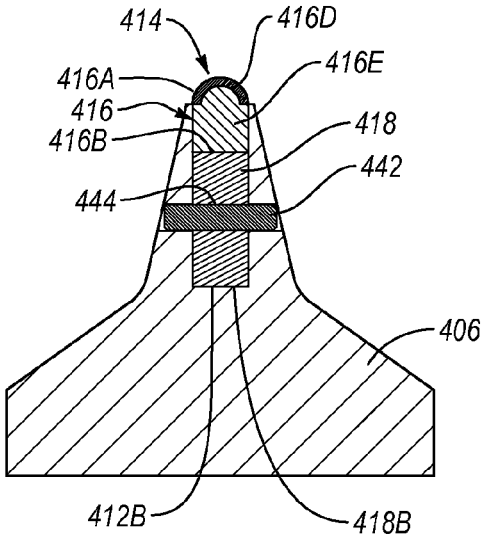
FIG. 4D is a partial, cross-sectional view of the cutter assembly shown in FIG. 4B with the cutting element attached.

With reference to FIGS. 4B, 4C, 4D, 4E, and 4F, as noted above, the cutting elements 414 may be at least partially secured in the pockets 412 via one or more mechanical fasteners extending generally traverse to a longitudinal axis of the pockets 412. As shown, each pocket 412 of the cutter ring 402 may include one or more side through hole 440 (e.g., two side through holes as shown in FIGS. 4B-4F) extending between the side portions 408 of the cutter ring 402 and the pocket 412. In an embodiment, a mechanical fastener 442 may be inserted through such one or more through hole 440 to at least partially secure the cutting element 414 in the pocket 412. For example, as shown in FIG. 4B, a side through hole 440 may extend between the side portions 408 of the cutter ring 402 and may traverse each pocket 412. In an embodiment, a channel 444 (shown in FIG. 4D) may be formed in the backing portion 418 of the cutting element 414. The channel 444 may be configured and positioned to generally aligned with the side through hole 440 when the cutting element 414 is positioned within the pocket 412. For example, the cutting element 414 may be secured in the pocket 412 by positioning a mechanical fastener 442 comprising a pin-like member into the side through hole 440 such that the fastener 442 traverses at least a portion of the pocket 412 through the channel 444 within the backing portion 418 thereby coupling or pinning the cutting element 414 in the pocket 412. In an embodiment, the mechanical fastener 442 may be press-fit into the side through hole 440. In other embodiments, the mechanical fastener 442 may include one or more materials configured to selectively expand or be positioned within the side through hole 440 such that a compression fit may be formed between the mechanical fastener 440 the cutter ring 402 and/or cutting element 414. In other embodiments, each end of the mechanical fastener 442 may include a retaining feature configured to maintain the mechanical fastener 442 within the side through hole 440. For example, in an embodiment, a first end of the mechanical fastener 442 may include a head portion having a bearing surface configured to engage the exterior surface of the side portion 408. A second end of the mechanical fastener 442 generally opposite the first end may include a receiving hole configured to receive a split pin or cotter pin configured to restrict longitudinal movement of the mechanical fastener through the side through hole 440.

Figure 4E:
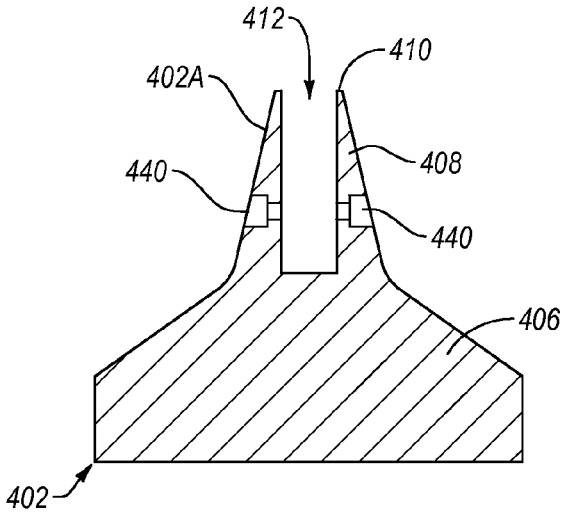
FIG. 4E is a partial, cross-sectional view of the cutter assembly shown in FIG. 4B with a cutting element removed according to another embodiment.
Figure 4F:
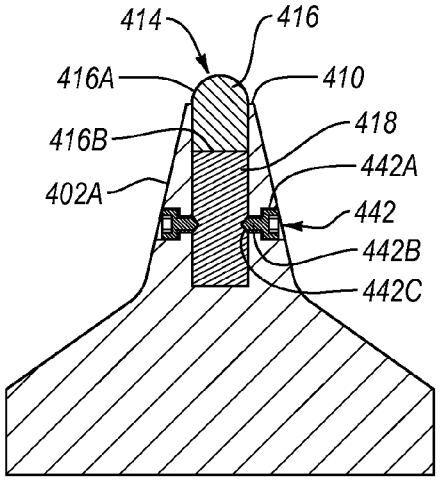
FIG. 4F is a partial, cross-sectional view of the cutter assembly shown in FIG. 4E with the cutting element attached.

In other embodiments, the mechanical fasteners 442 may comprise a threaded fastener member. For example, FIGS. 4E through 4F illustrate partial, cross-sectional views of the cutting assembly 400 according to another embodiment. As shown, the mechanical fastener 442 may comprise a screw-like member including a head portion 442A and a shank 442B having an outer threaded surface. Optionally, the mechanical fastener 442 may also include a pointed free end portion 442C having an outer threaded surface. In an embodiment, each mechanical fastener 442 may be inserted or screwed into the side through holes 440 such that at least the pointed portion 442C of the mechanical fastener 442 threadedly engages the backing portion 418 of the cutting element 414. By threadedly engaging the backing portion 418 with the mechanical fastener 442, the risk of the mechanical fastener 442 backing out of the side through hole 440 may be reduced. In an embodiment, one or more holes or grooves may be preformed in the backing portion 418 to receive the mechanical fasteners 442. In other embodiments, the pointed portion 442C of each of the mechanical fasteners 442 may form a hole in the backing portion 418 as the pointed portion 442C threadedly engages the backing portion 418. In an embodiment, each side through hole 440 may include a recessed portion near the outer surface 402A of the side portions 408 of the cutter ring 402. These recessed portions may be configured to receive the head portion 442A of the mechanical fasteners 442 such that the head portions 442A are recessed within the outer surface 402A of the side portions 408 or generally flush therewith. Optionally, the head portion 442A may include one or more driving slots/features configured to help rotate the mechanical fastener 442 in the side through holes 440.

The mechanical fasteners 442 may be formed from any number of different materials. For example, the mechanical fasteners 442 may include without limitation, a metal, alloy steel, other metal alloys such as a nickel superalloy, carbon steel, stainless steel, tungsten carbide, or any other suitable metal or conductive or non-conductive material. Further, while two mechanical fasteners 442 are illustrated extending into each pocket 412, in other embodiments, one, three, four, or any other suitable number of mechanical fasteners 442 may be associated with each pocket 412. Moreover, while each mechanical fastener 442 is illustrated including a threaded outer surface, in other embodiments, the shank 442B may be generally unthreaded and the mechanical fasteners 442 may be press-fit into the side through holes 440.

Figure 5A:
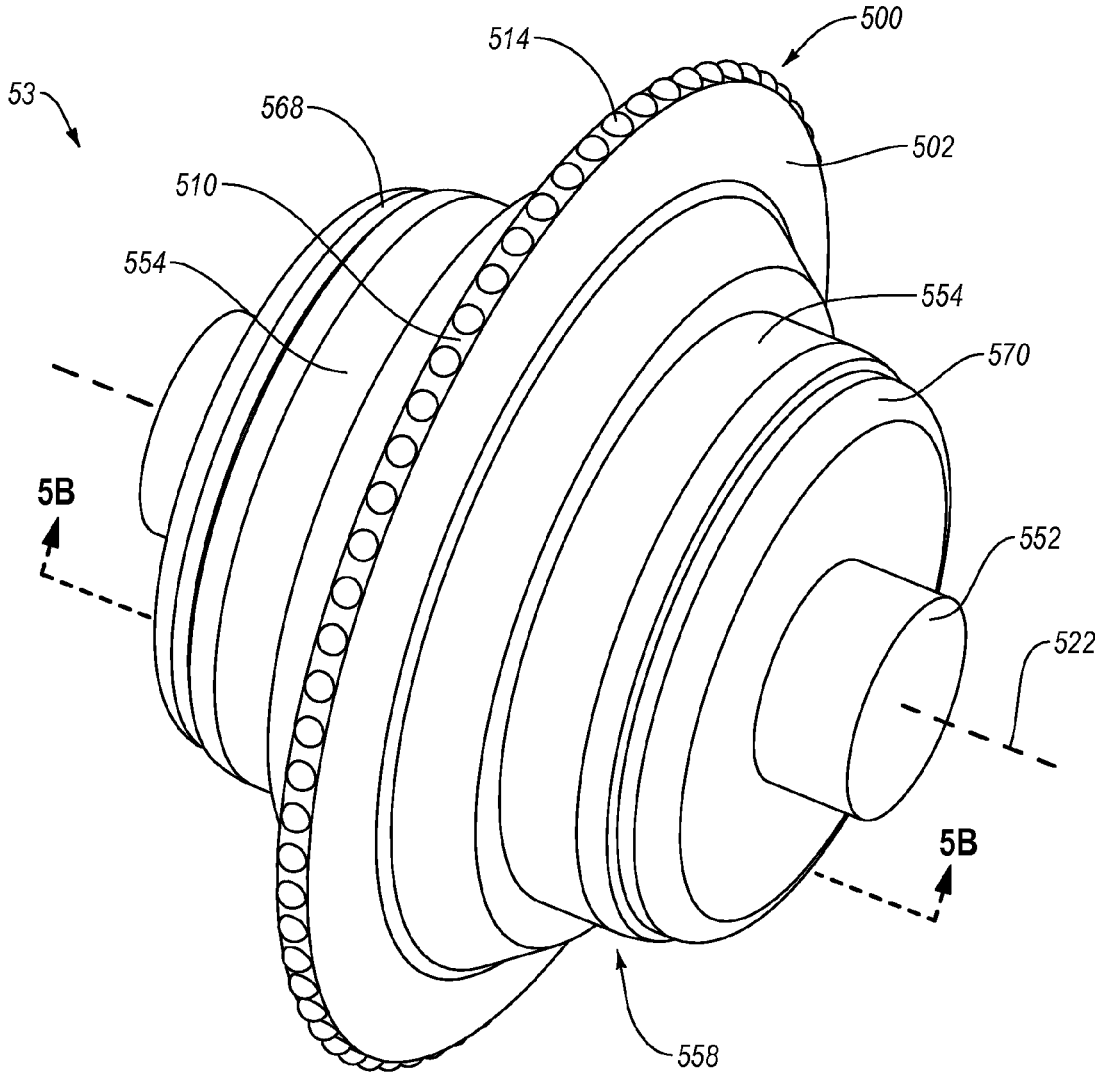
FIG. 5A is an isometric view of a disc cutter according to an embodiment.
Figure 5B:
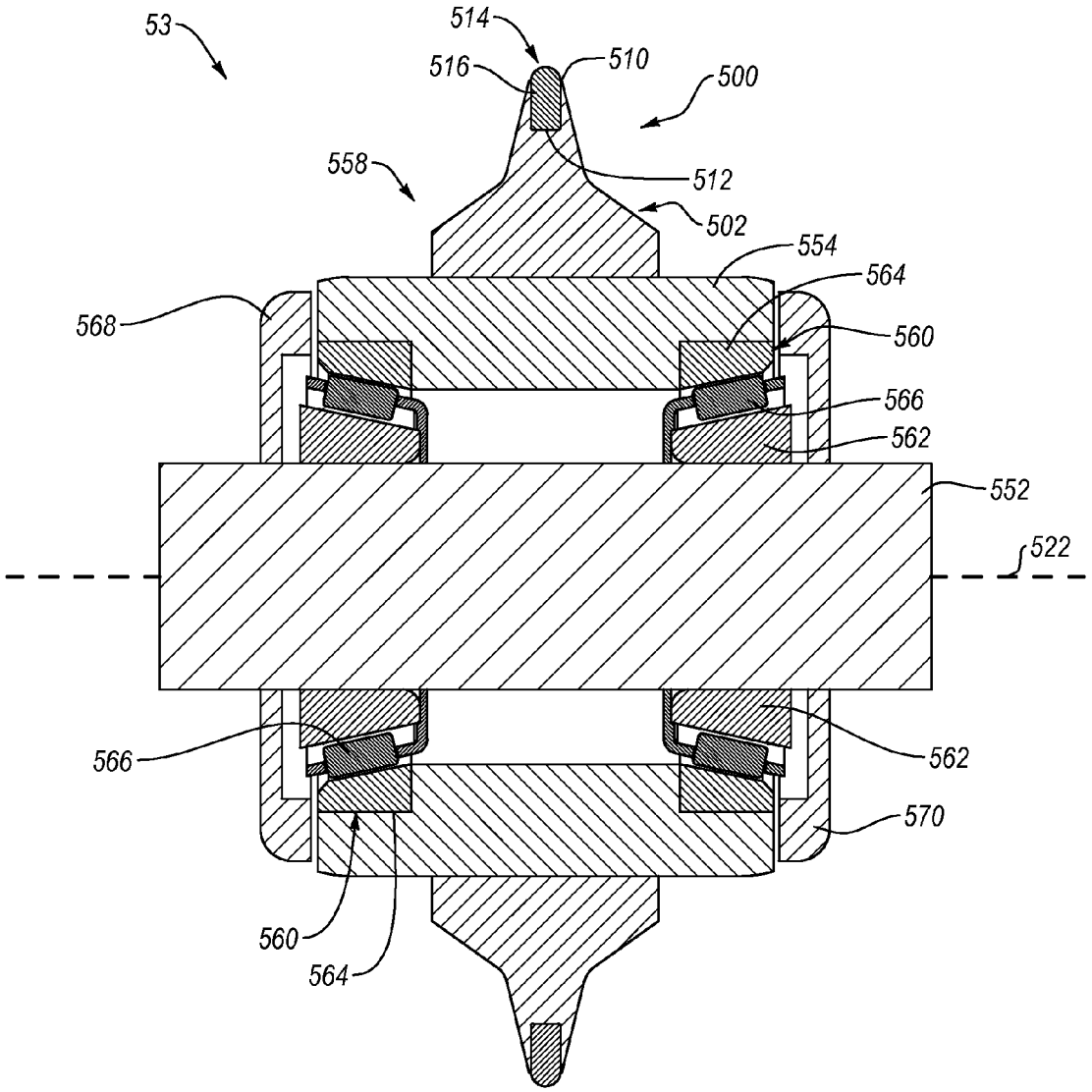
FIG. 5B is a cross-sectional view of the disc cutter taken along section line 5B-5B shown in FIG. 5A.

Any of the above-described cutter assemblies may be employed in a disc cutter for use in a TBM. For example, FIGS. 5A and 5B are isometric and cross-sectional views, respectively, of a disc cutter 53 according to an embodiment. The disc cutter 53 may include a shaft 552 that is configured to be fixedly attached to the TBM rotating head 11 (shown in FIG. 1). A cutter assembly 500 may be attached to a hub 554 to form a cutter apparatus 558. The cutter assembly 500 may be configured as any of the previously described embodiments of the cutter assemblies. The cutter assembly 500 may include a cutter ring 502 and a plurality of superabrasive cutting elements 514 partially disposed in a corresponding pocket 512 formed in a crest portion 510 of the cutter ring 502. Each cutting element 514 may include a superabrasive body 516 (e.g., PCD body) having a working upper surface and an opposing back surface. In an embodiment, the cutting elements 514 may be sized and configured to form a superabrasive cutting surface. For example, the cutting elements 514 may be positioned such that at least a portion of the working upper surface of each cutting element 514 projects beyond the crest 510 of the cutter ring 502. The cutting elements 514 may be mounted or otherwise attached to the cutter ring 502 in any suitable manner. For example, the cutting element 514 may be attached or secured to the cutter ring 502 via brazing, press-fitting, threadly attaching, fastening with a fastener, combinations of the foregoing, or any other suitable technique.

The cutter apparatus 558 may be rotatably mounted to the shaft 552 with a pair of bearing apparatuses 560. As shown, the cutter apparatus 558 may be configured to rotate about a rotation axis 522 extending along the shaft 552. In an embodiment, the bearing apparatuses 560 may each comprise an inner bearing race 562, an outer bearing race 564, and a plurality of roller bearings 566 (e.g., tapered roller bearings). In another embodiment, the bearings 566 may be diamond bearings as disclosed in copending Application, entitled "Tunnel Boring Machine Disc Cutters and Related Methods of Manufacture," filed on Mar. 8, 2013 having application Ser. No. 13/790,046, the disclosure of which is incorporated herein, in its entirety, by this reference. The cutter apparatus 558 may further include a pair of end retainer covers 568, 570 disposed on either side of the hub 554. During operation, the cutter apparatus 558 may be rotatable about the shaft 552, and the end retainer covers 568, 570 may be fixed to the shaft 552. In an embodiment, a seal assembly (not shown) may be located at the interface between each of the end retainer covers 568, 570 and the cutter apparatus 558. The seal assembly may be configured to help prevent the dirt or other contamination from entering the bearing apparatuses 560 that could damage or destroy the bearing apparatuses 560.

In an embodiment, the disc cutter 53 may be configured to perform the task of excavating material from a target surface or a tunnel face. For example, as the TBM head 11 (shown in FIG. 1) advances and rotates, the cutter apparatus 558 may rotate about the shaft 552 as the superabrasive cutting elements 514 of the cutter apparatus 558 are pushed against the tunnel face. In an embodiment, the superabrasive cutting elements 514 may fractionate, crush, and/or loosen materials on the tunnel face, which may be transported away by the TBM 10 (shown in FIG. 1). As previously discussed, by forming the cutting surface with the superabrasive cutting elements 514 rather than the cutter ring 502, wear of the disc cutter 53 and/or the risk of failure may be reduced.

The disc cutter 53 may be employed in a variety of mechanical applications. For example, TBMs, raise drilling systems, large diameter blind drilling systems, and other types of mechanical systems may benefit a disc cutter as discussed herein.

Figure 6:
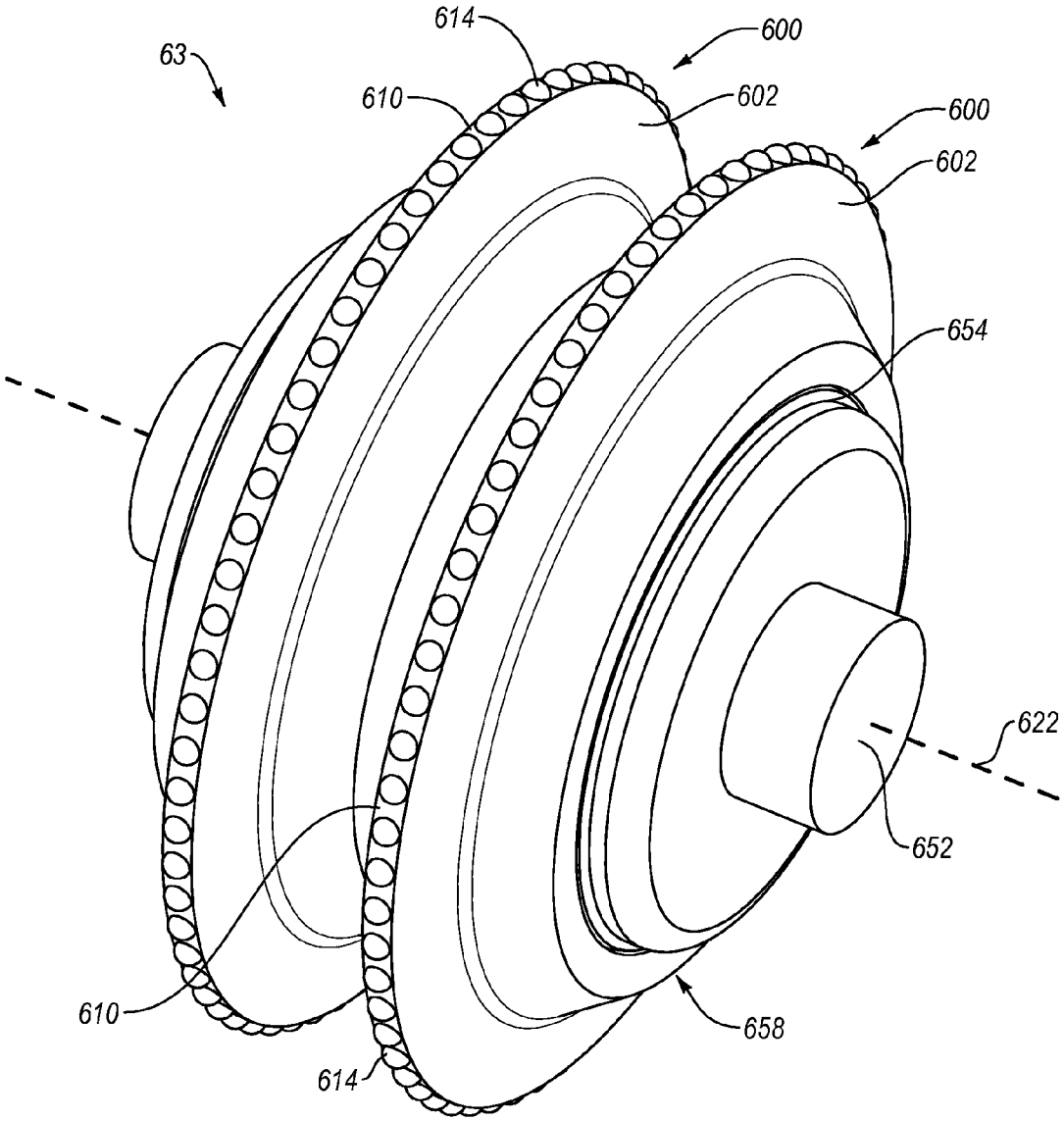
FIG. 6 is an isometric view of a disc cutter according to an embodiment.

While the disc cutter 53 is illustrated including a single cutter assembly 500, in other embodiments, the disc cutter 53 may include two, three, or any other suitable number of cutter assemblies 500. For example, as shown in FIG. 6, a disc cutter 63 may include two cutter assemblies 600. The disc cutter 63 may include a shaft 652 that is configured to be fixedly attached to the TBM rotating head 11 (shown in FIG. 1). The two cutter assemblies 600 may be attached to a hub 654, to form a cutter apparatus 658 rotatably mounted to the shaft 652. As shown, the cutter apparatus 658 may be configured to rotate about a rotation axis 622 extending through the shaft 652.

Each of the cutter assemblies 600 may be configured as any of the previously described embodiments of the cutter assemblies. For example, the cutter assemblies 600 may each include a cutter ring 602 and a plurality of superabrasive cutting elements 614 (e.g., PCD body) partially disposed in a corresponding pocket (not shown) formed in a crest portion 610 of the cutter ring 602. In an embodiment, both cutter assemblies 600 may be similarly configured. In other embodiments, each cutter assembly 600 may exhibit a different configuration.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall be open ended and have the same meaning as the word "comprising" and variants thereof (e.g., "comprise" and "comprises").

What is claimed is:

1. A cutter assembly for use on a tunnel boring machine, the cutter assembly comprising:

a cutter ring extending circumferentially about a central axis, the cutter ring including a radially inner surface and a radially outer surface including a plurality of pockets formed therein; and a plurality of superabrasive cutting elements distributed circumferentially about the axis, each of the plurality of superabrasive cutting elements attached to the cutter ring and positioned in a corresponding one of the plurality of pockets, each of the plurality of superabrasive cutting elements including a polycrystalline diamond ("PCD") body having a working surface, at least a number of the superabrasive cutting elements extending beyond the outer surface of the cutter ring; and at least one attachment feature configured to facilitate attachment of at least one of the plurality of superabrasive cutting elements to the cutter ring, the at least one attachment feature includes at least one of:

a recessed channel formed in the radially inner surface and extending circumferentially about the axis, and a plurality of mechanical fasteners, each of the plurality of mechanical fasteners extending through the radially inner surface of the cutter ring and attaching to a corresponding one of the plurality of superabrasive cutting elements, each of the plurality of mechanical fasteners partially positioned in the recessed channel;

a deformable member that is plastically deformed and occupies at least a portion of a recessed portion formed in the at least one of the plurality of superabrasive elements, the recessed portion partially defined by a shoulder of the at least one of the plurality of superabrasive elements and a portion of at least one side surface of the at least one of the plurality of superabrasive elements; or a plurality of first through holes extending through a side portion of the cutter ring into a corresponding one of the plurality of pockets, each of the plurality of first through holes being positioned radially outwardly and spaced from a radially-innermost portion of the corresponding one of the plurality of pockets.

2. The cutter assembly of claim 1, wherein the cutter ring includes a plurality of second through holes each of which extends between the recessed channel and a corresponding one of the plurality of pockets, and wherein each of the plurality of second through holes receives a corresponding one of the plurality of mechanical fasteners.

3. The cutter assembly of claim 2, wherein each of the plurality of mechanical fasteners includes a head portion positioned in the recessed channel and a shank extending through a corresponding one of the plurality of through holes and toward the recessed channel.

4. The cutter assembly of claim 3, wherein the shank includes an outer threaded portion and the at least one of the plurality of superabrasive cutting elements includes an aperture having an inner threaded portion configured to rotatably engage at least a portion of the outer threaded portion of the shank.

5. The cutter assembly of claim 4, wherein the shank includes one or more grooves positioned within the recessed channel, and wherein at least one of the plurality of mechanical fasteners comprises at least one of a spring-type washer, a conical spring washer, a wave washer, a split washer, a spring lock washer, or a toothed lock washer positioned within the one or more grooves.

6. The cutter assembly of claim 2, wherein the at least one of the plurality of superabrasive cutting elements includes a shank extending through at least one of the plurality of second through holes and toward the recessed channel.

7. The cutter assembly of claim 6, wherein each of the shank and a corresponding one of the plurality of mechanical fasteners includes a threaded portion configured to couple to one another.

8. The cutter assembly of claim 1, wherein at least one of the plurality of superabrasive cutting elements is attached to the cutter ring via one or more resilient members positioned between a side surface of a corresponding one of the plurality of pockets and the at least one of the superabrasive cutting elements.

9. The cutter assembly of claim 8, wherein the one or more resilient members comprises a snap ring, a c-clip, a pin, or a retaining ring.

10. The cutter assembly of claim 1, wherein at least one of the plurality of superabrasive cutting elements is attached to the cutter ring via a taper lock fit or a press fit between the least one of the plurality of superabrasive cutting elements and a side surface of at least one of the pockets.

11. The cutter assembly of claim 1, wherein the deformable member is configured to occupy at least a portion of one or more grooves formed in a side surface of the corresponding one of the pockets.

12. The cutter assembly of claim 1, wherein the deformable member is configured to occupy at least a portion of one or more grooves formed in a side surface of the at least one of the superabrasive elements.

13. The cutter assembly of claim 1, wherein the cutter ring includes a base portion, a pair of generally curved side portions that extend toward a crest portion, and the plurality of first through holes extending through the pair of generally curved side portions into the corresponding one of the plurality of pockets pocket.

14. The cutter assembly of claim 13, wherein at least one of the superabrasive elements is secured to the cutter ring via a corresponding one of the plurality mechanical fasteners positioned in a corresponding one of the plurality of first through holes.

15. The cutter assembly of claim 14, wherein each of the plurality of mechanical fasteners comprises a set screw.

16. A disc cutter, comprising:

a shaft; and a cutter assembly rotatably mounted on the shaft, the cutter assembly including:

a cutter ring extending circumferentially about a central axis, the cutter ring including a radially inner surface and a radially outer surface including a plurality of pockets formed therein;

a plurality of superabrasive cutting elements distributed circumferentially about the axis, each of the plurality of superabrasive cutting elements attached to the cutter ring and positioned in a corresponding one of the plurality of pockets, each of the plurality of superabrasive cutting elements including a PCD body having a working surface, at least a portion of the one or more of the superabrasive cutting elements extending beyond the outer surface of the cutter ring; and at least one attachment feature configured to facilitate attachment of at least one of the plurality of superabrasive cutting elements to the cutter ring, the at least one attachment feature includes at least one of:

a recessed channel formed in the radially inner surface and extending circumferentially about the axis, and a plurality of mechanical fasteners, each of the plurality of mechanical fasteners extending through the radially inner surface of the cutter ring and attaching to a corresponding one of the plurality of superabrasive cutting elements, each of the plurality of mechanical fasteners partially positioned in the recessed channel;

a deformable member that is plastically deformed and occupies at least a portion of a recessed portion formed in the at least one of the plurality of superabrasive elements, the recessed portion partially defined by a shoulder of the at least one of the plurality of superabrasive elements and a portion of at least one side surface of the at least one of the plurality of superabrasive elements; or a plurality of first through holes extending through a side portion of the cutter ring into a corresponding one of the plurality of pockets, each of the plurality of first through holes being positioned radially outwardly and spaced from a radially-innermost portion of the corresponding one of the plurality of pockets; and one or more bearing apparatuses rotatably mounting the cutter assembly to the shaft.

17. The disc cutter of claim 16, wherein at least one of the one or more bearing apparatuses comprises an inner bearing race, an outer bearing race, and a plurality of tapered roller bearings.

18. A method of manufacturing a cutter assembly for use on a tunnel boring machine, the method comprising:

coupling a plurality of superabrasive cutting elements to a cutter ring, wherein the cutter ring includes an inner surface and an outer surface including a plurality of pockets formed therein that carry the plurality of superabrasive cutting elements, wherein each of the plurality of superabrasive cutting elements is positioned in a corresponding one of a plurality of pockets formed in the outer surface of the cutter ring, wherein at least a portion of one or more of the plurality of superabrasive cutting elements extend beyond the outer surface of the cutter ring; and wherein coupling at least one of the plurality of superabrasive cutting elements to a cutter ring includes coupling the at least one of the plurality of superabrasive cutting elements to the cutter ring using at least one attachment feature, the at least one attachment feature including at least one of:

a recessed channel formed in the radially inner surface and extending circumferentially about the axis, and a plurality of mechanical fasteners, each of the plurality of mechanical fasteners extending through the radially inner surface of the cutter ring and attaching to a corresponding one of the plurality of superabrasive cutting elements, each of the plurality of mechanical fasteners partially positioned in the recessed channel;

a deformable member that is plastically deformed and occupies at least a portion of a recessed portion formed in the at least one of the plurality of superabrasive elements, the recessed portion partially defined by a shoulder of the at least one of the plurality of superabrasive elements and a portion of at least one side surface of the at least one of the plurality of superabrasive elements; or a plurality of first through holes extending through a side portion of the cutter ring into a corresponding one of the plurality of pockets, each of the plurality of first through holes being positioned radially outwardly and spaced from a radially-innermost portion of the corresponding one of the plurality of pockets.

* * * * *